US006127987A

United States Patent [19]

Maruyama et al.

[11] Patent Number: 6,127,987

[45] Date of Patent: Oct. 3, 2000

[54] ANTENNA AND MANUFACTURING METHOD THEREFOR

[75] Inventors: Tamami Maruyama; Kazuhiro Uehara; Kenichi Kagoshima, all of Tokyo, Japan

[73] Assignee: Nippon Telegraph and Telephone Corporation, Japan

[21] Appl. No.: 09/074,176

[22] Filed: May 7, 1998

[30] Foreign Application Priority Data

| | | | |
|---|---|---|---|
| May 9, 1997 | [JP] | Japan | 9-119385 |
| Sep. 26, 1997 | [JP] | Japan | 9-262533 |
| Oct. 3, 1997 | [JP] | Japan | 9-270858 |

[51] Int. Cl.[7] ..... H01Q 19/00; H01Q 21/00

[52] U.S. Cl. ..... 343/835; 343/833; 343/824; 343/845

[58] Field of Search ..... 343/772, 833, 343/834, 824, 815, 854, 845, 835; H01Q 19/00, 21/00

[56] References Cited

U.S. PATENT DOCUMENTS

| | | | |
|---|---|---|---|
| 4,213,132 | 7/1980 | Davidson | 343/854 |
| 5,111,210 | 5/1992 | Morse | 342/455 |
| 5,266,961 | 11/1993 | Milroy | 343/772 |
| 5,361,076 | 11/1994 | Milroy | 343/772 |

FOREIGN PATENT DOCUMENTS

| | | |
|---|---|---|
| 0 172 626 A1 | 2/1986 | European Pat. Off. . |
| 32 19 365 C1 | 7/1986 | Germany . |
| 1-165206 | 6/1989 | Japan . |
| 6-204735 | 7/1994 | Japan . |
| 9-27713 | 1/1997 | Japan . |
| 9-36654 | 2/1997 | Japan . |
| 9-135115 | 5/1997 | Japan . |
| 10-51233 | 1/1998 | Japan . |

OTHER PUBLICATIONS

T. Maruyama et al., "Design and analysis of small multi–sector antenna for wireless LANs made by monopole Yagi–Uda array antenna", IEICE, Japan vol. J80–B2, No. 5, pp. 424–433, May 1997.

T. Maruyama et al., "Analysis and design of multi–sector monopole Yage–Uda array mounted on a ground plane using moment method", CEM'97, IEEE 3rd International Conference on Computation in Electromagnetics, UK, Conf. Publication No. 420, pp. 289–294, No. 420, Apr. 1996.

(List continued on next page.)

*Primary Examiner*—Don Wong
*Assistant Examiner*—Hoang Nguyen
*Attorney, Agent, or Firm*—Pennie & Edmonds LLP

[57] ABSTRACT

An antenna comprising the following members are provided: a first board-shaped dielectric material; a cylindrical member, provided on one face of the first board-shaped dielectric material, in which a part of a side wall may be cut off; plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first board-shaped dielectric material, the sets radiating from the outer surface of the cylindrical member and the plural pole members in each set being arranged in a line, and each set existing between two positional directions of the adjacent two second board-shaped members. The surface as one face of the first board-shaped dielectric material and the surfaces of each above member are coated with a conductive coating, by which the first board-shaped dielectric material, the cylindrical member, the second board-shaped members, and the pole members respectively function as a ground plane, a reflector, fins, and parasitic elements. A radiator is provided on an extension from each line on which a set of the parasitic elements on the ground plane exists and between the innermost parasitic element and the outer surface of the reflector.

26 Claims, 33 Drawing Sheets

OTHER PUBLICATIONS

T. Maruyama et al., "Rigorous analysis of a multi–sector monopole Yagi–Uda antenna with metallic fins", Proc. of ISAP'96, in edit, Sep. 1996.

T. Maruyama et al., "Analysis of multi sector monopole Yagi–Uda array antenna", Technical Report of IEICE, AP 95–90, 1995–12, pp. 39–45, Dec. 1996.

T. Maruyama et al., "Analysis and design of planar multi–sector antenna adapted to several sector numbers using multi–sector monopole Yagi–Uda array (MS–MPYA)", Technical Report of IEICE, AP97–80, 1997–8, pp. 1–8, Aug., 1997.

T. Maruyama et al., "Analysis and design of monopole Yagi–Uda array antenna mounted on finite size ground plane using by mounte method", Society Conference of IEICE 1995, B–74.

T. Maruyama et al., "Analysis of monopole Yagi–Uda sector array antennas with metallic fin mounted on finite ground plane by using method of moment", General Conference of IEICE 1996, B–105.

T. Maruyama et al., "The design of multi sector monopole Yagi–Uda array antennas by using method of moment", Society Conference of IEICE 1996, B64.

T. Maruyama et al., "Near field analysis of multi–sector monopole Yagi–Uda array antennas with the finite ground plane", General Conference of IEICE 1997, B–1–92.

T. Maruyama et al., "Planar multi–sector antenna adapted to several sector numbers using multi–sector monopole Yagi–Uda array (MS–MPY A)", Communication society confer. of IEICE 1997, B– 1 –46.

"19GHz band data transmission radio equipment for premises radio station", RCR STD–34, Research & Development Center for Radio Systems, Mar. 1993.

T. Okada et al., "VJ25 system: 19GHz high–speed wireless LAN system", NTT Review, vol. 9, pp. 86–92, Jan. 1997.

T. Shirato et al., "A 19 GHz band wireless LAN", NTT R&D, vol. 45, No. 8, pp. 95–104, Aug., 1996.

K. Uehara et al., "A 20 GHz12 Sector antenna using planner multibeam arrays", IEICE, Proc. of the '96 General Conference, B–107, 1996.

James E. Mitzlaff, "Radio propagation and anti–multipath techniques in the WIN environment", IEEE Network Magazine, vol. 5, No. 6, pp. 21–26, Nov. 1991.

J. L. Lawson, "Yagi antenna design", U.S. Department of Commerce National Technical Information Service, PB–262, 885, Dec. 1976.

"Dynamic ham series–antenna handbook", CQ Shuppan–sha, p. 353, Feb. 1985.

Y. Naito, "Guidance of Information Transmission", Shoko–do, pp. 195–199, Apr. 1976.

K. Uehara et al., "Indoor propagation calculation considering antenna patterns using geometrical optics method", The transactions of IEICE, vol. J78–b–2, No. 9, Sep. 1995.

T. Suzuki et al., "Corner reflector antenna with the same beam width in two frequency bands", The transactions of IEICE, vol. J75–B–2, No. 12, pp. 950–956, Dec. 1992.

MEASURED DATA OF RADIATION PATTERN
IN HORIZONTAL PLANE BEAM WIDTH AT 3 dB:28°

—— MANUFACTURING METHOD ACCORDING TO THE PRESENT INVENTION

----- CONVENTIONAL MANUFACTURING METHOD

MEASURED DATA OF RADIATION PATTERN
IN VERTICAL PLANE BEAM WIDTH AT 3 dB:28°

—— MANUFACTURING METHOD ACCORDING TO THE PRESENT INVENTION

----- CONVENTIONAL MANUFACTURING METHOD

ANTENNA AND MANUFACTURING METHOD THEREFOR

BACKGROUND OF THE INVENTION

1. Field of the Invention

The present invention relates to an antenna (system) used for wireless communication, and also relates to an antenna structure and to a manufacturing method therefor for easily realizing a monopole array antenna with a high accuracy, used for high-speed data communication such as an LAN, using microwave, quasimillimeter wave, or millimeter wave band.

This application is based on Patent Applications Nos. Hei 9-119385, Hei 9-262533, and Hei 9-270858 filed in Japan, the contents of which are incorporated herein by reference.

2. Description of the Related Art

Conventionally, antennas for terminal units used for on-site wireless LANs and the like are arranged on a desk, at a personal computer or workstation, at the upper end of a partition, or the like.

In high-speed radio communication having a transmission rate more than 10 Mbps, such as a wireless LAN, antennas with high directivity and actual gain are required. On the other hand, terminal units desirably have a function of radiating a beam in all directions (i.e., 360°) in a horizontal plane, so that radio waves can always be received regardless of directional arrangement of a base station. A 19 GHz-band wireless LAN with high transmission rate of 25 Mbps and maximum throughput of 15 Mbps has been developed based on RCR STD-34 standard (refer to "19 GHz band Data Transmission Radio Equipment for Premises Radio Station", Research & Development Center for Radio Systems, March, 1993). (Also refer to "VJ25 System: 19 GHz High-speed Wireless Lan System", *NTT REVIEW*, Vol. 9, pp. 86–92, January, 1997.)

Regarding such a system, an analysis report is known in which specification of a terminal necessary for realizing a transmission rate of 25 Mbps with an omnidirectional antenna at a base station is analytically examined using a model based on geometrical optics. In the specification, "half-width in horizontal (or conical) plane: 30°, half-width in vertical plane: 30°, directivity gain: 15 dBi or more" are defined.

As a conventional antenna which can realize the above specifications, a three-dimensional corner reflector and a three-dimensional corner reflector provided with a dielectric material are known (refer to T. Shirato, et al., "A 19 GHz Band Wireless LAN", NTT R&D, Vol. 45, No. 8, pp. 95–104, August, 1996).

In these antennas, directivity or beam width are basically determined according to the sizes of the aperture and ground plane radius. Therefore, it is difficult to reduce the height and the diameter of the ground plane (or plate), and accordingly, weight cannot be reduced.

Another technique in which a fin is provided in order to lower (the height of) a three-dimensional corner reflector has been proposed in Japanese Patent Application, First Publication, No. Hei 9-135115. However, in this case, the fin is arranged in parallel to the ground plane; thus, the structure is complicated and processes necessary for manufacturing are increased.

On the other hand, a planar patch antenna having a smaller volume than the above three-dimensional corner reflector, for realizing reduction in size, has been proposed (refer to K. Uehara, et al., "A 20 GHz 12 Sector Antenna Using Planner Multibeam Arrays", IEICE, Proceedings of the '96 General Conference, B-107, 1996").

However, it is necessary (i) to secure sufficient aperture in the longitudinal direction so as to obtain an exact directionality in the vertical plane, and (ii) to secure sufficient aperture in the cross direction so as to obtain an exact directionality in the horizontal plane. Therefore, also in this case, it is difficult to realize an antenna having a thinner structure, and loss in a feeder circuit is increased.

Another conventional example using a horn antenna for a 6-sector wireless LAN terminal unit has also been proposed (refer to James E. Mitzlaff, "Radio Propagation and Anti-Multipath Techniques in the WIN Environment", IEEE Network Magazine, Vol. 5, No. 6, pp. 21–26, November, 1991). The size required in this case is 20 mm (longitudinal direction)×15 mm (cross direction). Therefore, if twelve 12-sector antennas with a narrower beam are arranged using the above structure, both the necessary opening area of the aperture and the necessary number of antennas are doubled, and thus the total size becomes almost four times greater. That is, reduction in size is also difficult in this case.

As another type of antenna, an arrangement in which a monopole array antenna is arranged on a ground plane in a circumferential direction so as to cover the area with respect to the circumferential direction (see Japanese Patent Application, First Publication, No. Hei 9-36654). According to this antenna, the same characteristics as the above corner reflector antenna can be realized at one-third the height in comparison to the corner reflector antenna (refer to T. Maruyama, et al., "Design and Analysis of Small Multi-Sector Antenna for Wireless LANs Made by Monopole Yagi-Uda Array Antenna", Transactions of IEICE, B-II, No. 5, pp. 424–433, May, 1997). Here, the monopole Yagi-Uda antenna is a kind of monopole array antenna.

FIG. 12A is a perspective view showing the appearance of a conventional monopole array antenna. In this example, radiator 21, reflector 22*a*, and plural (here, 10) parasitic elements (or directors) 22*b*–22*k* are arranged with a predetermined space left between each two of these elements, in (the same plane of) plate 20 made of a conductive material, and connector (or connecting section) 23 is provided on the back face of the conductive plate 20. Conduction between the core wire of a coaxial cable introduced from a radio transmitting and receiving device (not shown) and radiator 21 can be established using the connector 23.

Conventionally, the monopole array antenna of such a structure is made in a manner such that pole antenna elements operating as radiator 21, reflector 22*a*, and parasitic elements 22*b*–22*k* are previously processed to have specific sizes, radiator 21 is disposed in hole 24 (for inserting the radiator); reflector 22*a* is pressed into hole 25*a* (for inserting the reflector); and parasitic elements 22*b*–22*k* are respectively pressed into holes 25*b*–25*k* (for inserting the parasitic elements), these holes being arranged having a predetermined space between each two of them, as shown in FIG. 12B of the corresponding partial cross sectional perspective view.

Here, the monopole array antenna is formed such that the lengths of antenna elements are arranged in order from 0.25 to 0.2 times as long as the wavelength and that no antenna length (or height) exceeds the height of the respective ordered antennas. If the transmission frequency rate is 19 GHz, the corresponding wavelength becomes 15 mm; thus, the height difference between adjacent antenna elements is defined with an order of 0.01 mm level and thus machining is very difficult. That is, in order to manufacture such a precision antenna, measurement of an accuracy using a special microscope is necessary after basic processing is completed, and readjustment is further necessary if any error is found. Therefore, in consideration of mass production, the cost required for adjustment of antenna elements is greatly increased, and consequently manufactured antennas become very expensive.

SUMMARY OF THE INVENTION

Accordingly, an object of the present invention is to provide an antenna having a structure for easy manufacturing and a manufacturing method thereof Therefore, the present invention provides an antenna comprising a first board-shaped dielectric material; a cylindrical member, provided on one face of the first board-shaped dielectric material, in which a part of a side wall may be cut off; plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first board-shaped dielectric material, the sets radiating from the outer surface of the cylindrical member and the plural pole members in each set being arranged in a line, and each set existing between two positional directions of the adjacent two second board-shaped members. In the above structure, the surface as one face of the first board-shaped dielectric material and the surfaces of each above member are coated with a conductive coating, by which the first board-shaped dielectric material, the cylindrical member, the second board-shaped members, and the pole members respectively fuinction as a ground plane, a reflector, fins, and parasitic elements; and a radiator is provided on an extension from each line on which a set of the parasitic elements on the ground plane exists and between the innermost parasitic element and the outer surface of the reflector. That is, an antenna having the above features and a manufacturing method thereof are provided according to the present invention.

According, a multi-sector corner reflector antenna can be easily manufactured via a simple process such that the surface of a dielectric material formed using a mold is coated by a metallic thin film. The mold used in the process has a simple structure which includes concave portions corresponding to the relevant members to be forced-out; thus, the antenna can be economically manufactured.

In addition, the mold and the dielectric material as a main body of the antenna which is molded using this mold can be easily separated toward a single direction after molding, according to structural features of the mold and the dielectric material. Therefore, manufacturing with a good yield rate can be performed.

Consequently, highly-accurate antennas can be very economically and easily manufactured.

BRIEF DESCRIPTION OF THE DRAWINGS

FIGS. 4A and 4B show an exemplary structure for reinforcing the parasitic elements, and the like.

DESCRIPTION OF THE PREFERRED EMBODIMENTS

In explanations of the embodiments, an antenna (system) of a structure suitable for easy manufacturing, and a corresponding manufacturing method, are firstly explained. Antennas having a structure for easy manufacturing (as mentioned above) and also having a distinctive strip line (connected with a radiator) are secondly explained. Furthermore, antennas having the above features and also consisting of plural antenna units of different operational frequencies are thirdly explained.

Antenna (system) of a structure for easy manufacturing

Figure 1A:
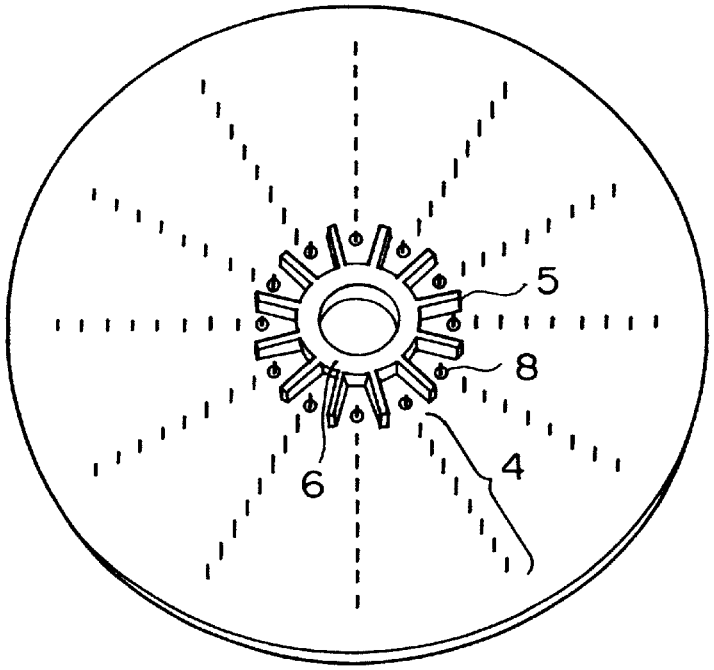
FIGS. 1A and 1B show the first embodiment according to the present invention.
Figure 1B:
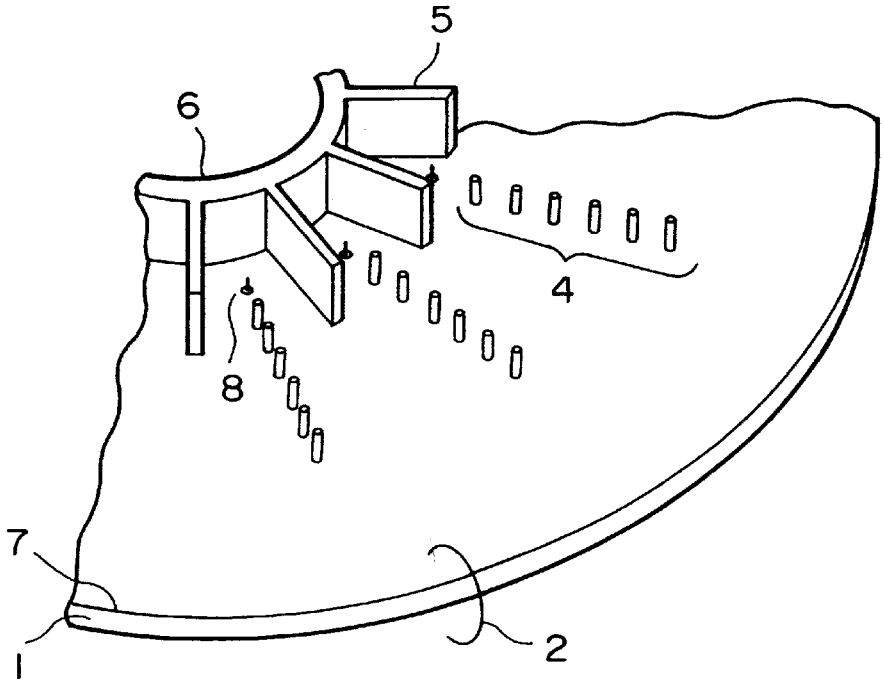

FIGS. 1A and 1B show an antenna as the first embodiment according to the present invention, and FIG. 1A is a perspective view of an antenna with a circular ground plane (or plate) while FIG. 1B is a partially enlarged view of FIG. 1A. In the figures, reference numeral 1 indicates a dielectric material, reference numeral 2 indicates a ground plane, reference numeral 4 indicates parasitic element(s) (or director(s)), reference numeral 5 indicates fin(s) (as partition plate(s)), reference numeral 6 indicates a reflector, reference numeral 7 indicates a metallic coat, and reference numeral 8 indicates radiator(s), As dielectric material 1, a material suitable as a medium used for a metal mold, that is, insulating and highly flowable material such as polymeric material (e.g., aromatic polyester) may be used.

In the antenna structure as shown in FIGS. 1A and 1B, projecting portions only exist at the upper side of the antenna, and the antenna has a uniform structure in the vertical direction. Therefore, this antenna can be manufactured using a mold which is pulled only toward one direction (i.e., upper direction).

Figure 2A:
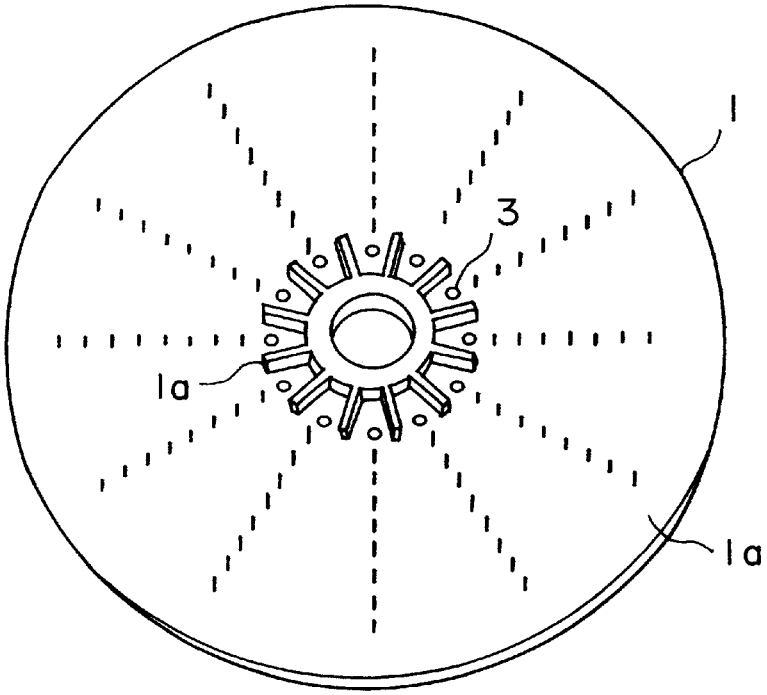
FIGS. 2A and 2B show a shape of the dielectric material.
Figure 2B:
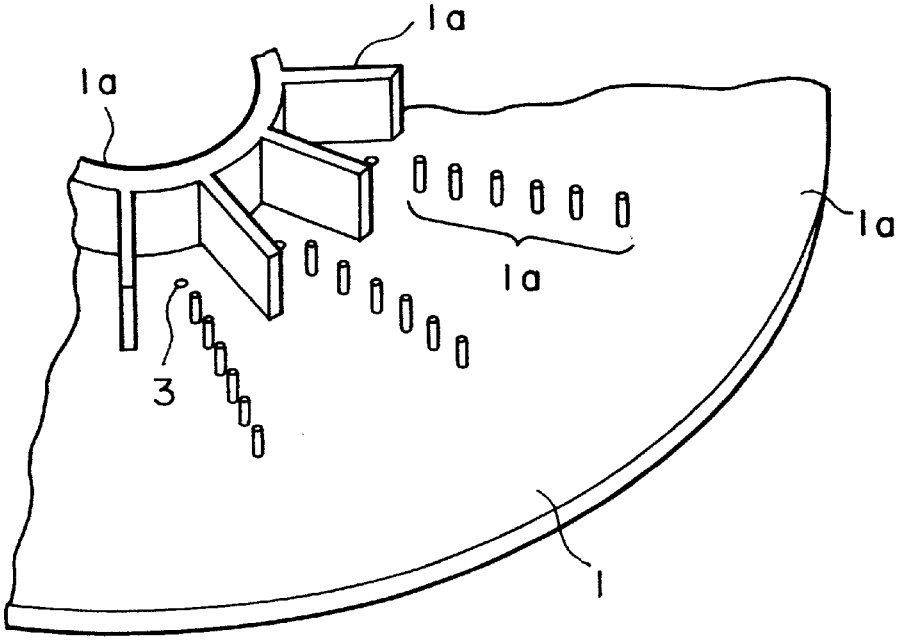

FIGS. 2A and 2B show a shape of the dielectric material as the main body of the antenna as shown in FIG. 1A. Similar to FIGS. 1A and 1B, FIG. 2A is a perspective view of the (whole of) dielectric material, while FIG. 2B is a partially enlarged view of FIG. 2A. In the figures, reference numeral 1 indicates a dielectric plate, reference numeral 1*a* indicates projection portion(s) also of the dielectric material, and reference numeral 3 indicates hole(s) for providing the radiator(s). The portions which should be ground plane 2, parasitic elements 4, fins 5, and, reflector 6 in FIG. 1 are formed by forcing out corresponding areas in dielectric plate 1 and then by coating the dielectric material with a metallic coat; thus, obtained projection portions of the dielectric material are indicated using reference numerals 1*a*, here.

The main structure of the antenna in the present embodiment is thus constructed such that the surface of the dielectric structure as shown in FIG. 2 is coated with a metallic coat. As the metallic coat, tungsten and nickel of a thickness of 5 $\mu$m and copper of a thickness of 5 $\mu$m for spreading the plating well, and gold or silver of a thickness of 0.02 $\mu$m for obtaining good conductivity, may be used. As tungsten and nickel are easily adhered to plastic material, they are used as the first layer with respect to the dielectric material, and gold or silver is used as an outer layer for increasing conductivity. Here, a copper layer is provided because gold or silver are not easily adhered to tungsten and nickel.

As explained above, in the antenna of the present embodiment, all main structural elements such as parasitic elements are integrally constructed, and the integral body is coated with a metallic coat by plating or the like. Accordingly, adjustment of these various kinds of elements is unnecessary, and a large quantity of products can be manufactured in a relatively short time.

Figure 3A:
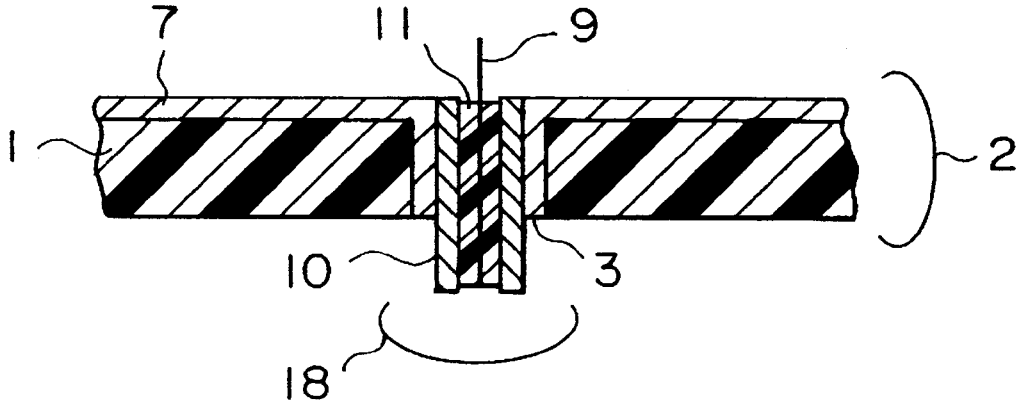
FIGS. 3A and 3B are sectional views for showing an example for installing the radiator.
Figure 3B:
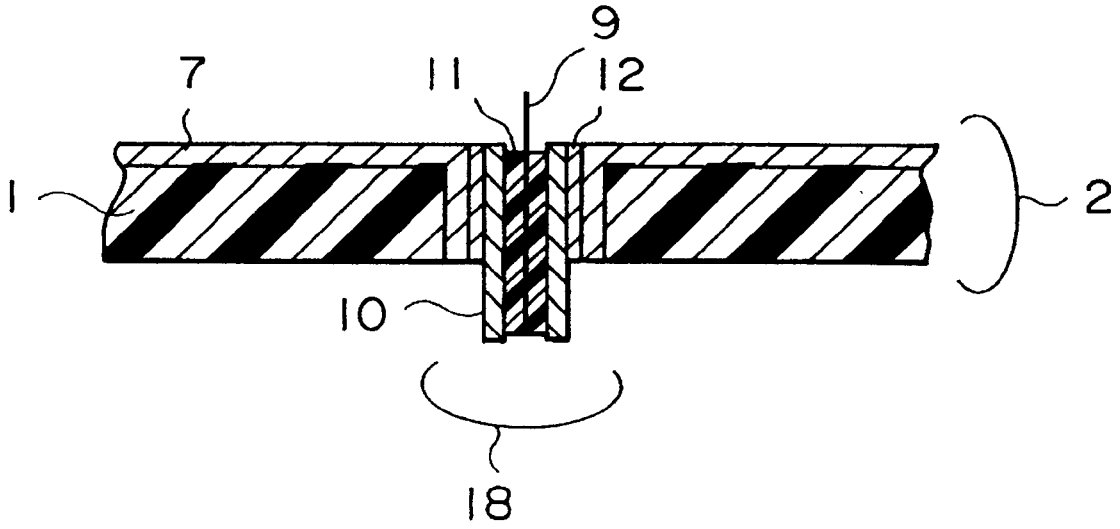

FIGS. 3A and 3B are sectional views for showing an example for installing the radiator of the antenna shown in FIGS. 1A and 1B. In this example, an inner conductor of a semi-rigid cable is used as the radiator. In FIGS. 3A and 3B, reference numeral 1 indicates a dielectric material, reference numeral 2 indicates a ground plane, reference numeral 3 indicates a hole made in the ground plane, reference numeral 7 indicates a metallic coat, reference numeral 9 indicates an inner conductor (or core wire) of a semi-rigid cable, reference numeral 10 indicates an outer conductor of a semi-rigid cable, reference numeral 11 indicates a dielectric material filled between the inner and outer conductors of the semi-rigid cable, reference numeral 12 indicates adhesive (material) such as solder, and reference numeral 18 indicates a semi-rigid cable.

In the method as shown by FIG. 3A, the radiator (i.e., inner conductor 9 of the semi-rigid cable) is fixed by pressing outer conductor 10 of semi-rigid cable 18 into the hole made in ground plane 2.

In the method as shown by FIG. 3B, the radiator (i.e., inner conductor 9 of the semi-rigid cable) is fixed by inserting outer conductor 10 of semi-rigid cable 18 into the hole made in ground plane 2 and then by gluing the semi-rigid cable 18 to ground plane 2 using adhesive 12 such as solder.

In the above structure, it is unnecessary to provide a pole conductor as a radiator and to connect the conductor to a semi-rigid cable or the like as a feeder.

Figure 4A:
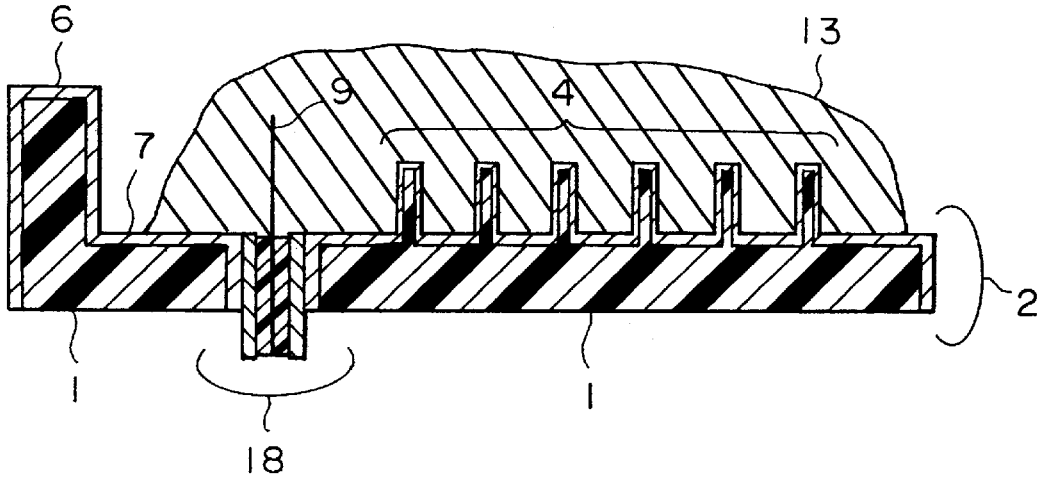
Figure 4B:
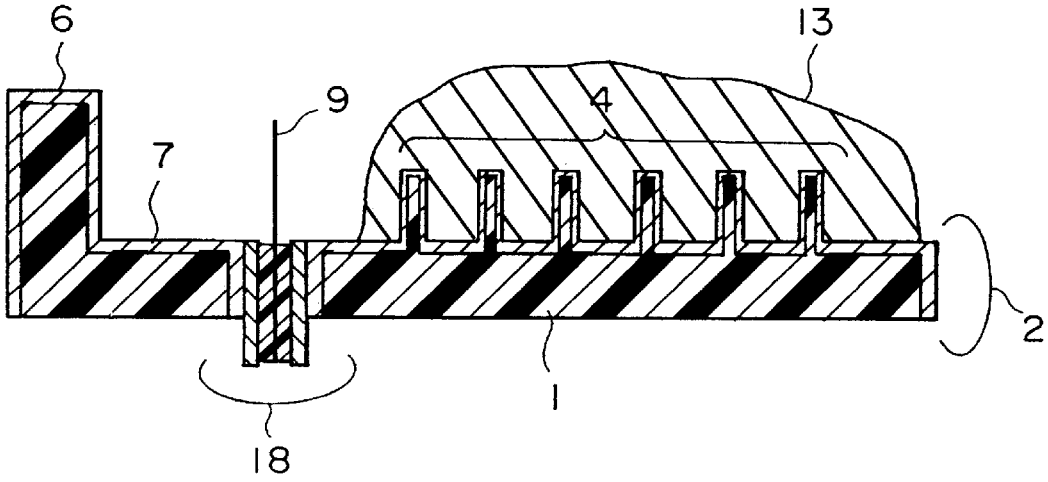

FIGS. 4A and 4B show an exemplary structure for reinforcing the radiator, parasitic elements, and the like, as sectional views of the antenna. In the figures, reference numerals 1, 2, 4, 6, 7, 9, and 18 respectively indicate the same elements in the former figures, and reference numeral 13 indicates a hardening material having the relative dielectric constant of almost 1.

FIG. 4A shows a structure in which both inner conductor 9 (as a radiator) of the semi-rigid cable and parasitic elements 4 are fixed using hardening material 13, while FIG. 4B shows another structure in which only parasitic elements 4 are fixed using hardening material 13.

As explained above, the surface of each element is covered by hardening material, by which these fine elements can be mechanically protected and are not easily affected by corrosive gas included in the air, or the like. Accordingly, characteristics of the antenna can be stably maintained over a long time. Furthermore, not only the radiator or parasitic elements, but also the whole antenna may be covered using a hardening material.

Figure 5A:
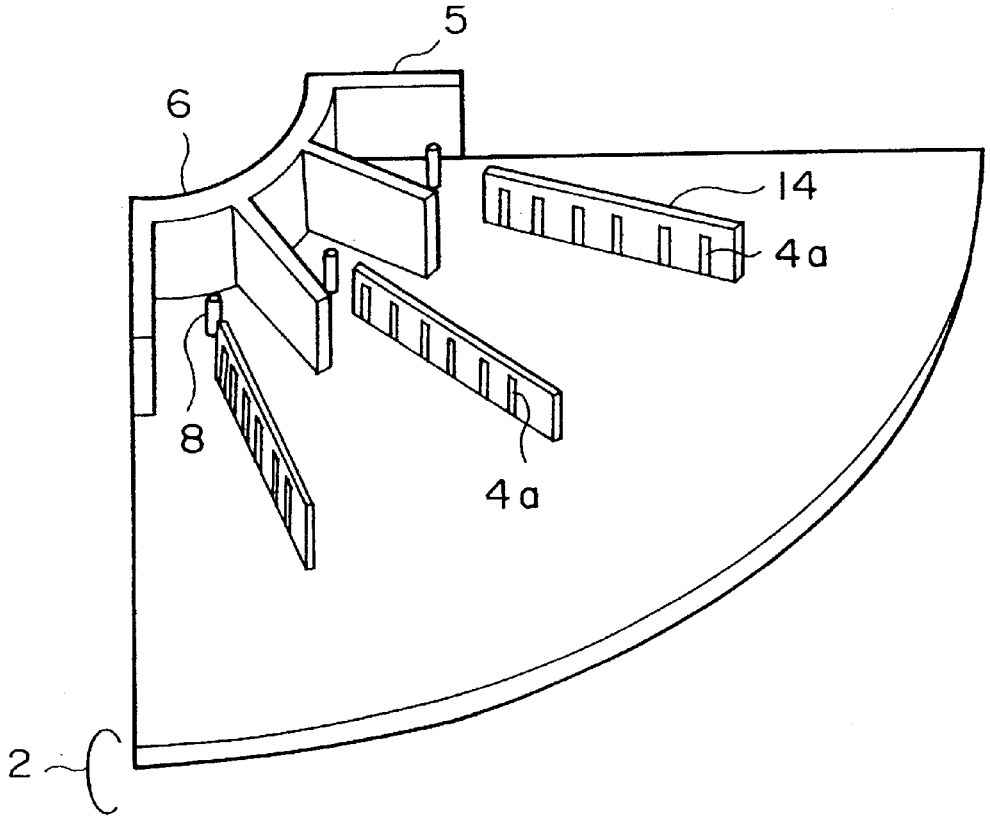
FIGS. 5A and 5B show the second embodiment according to the present invention.
Figure 5B:
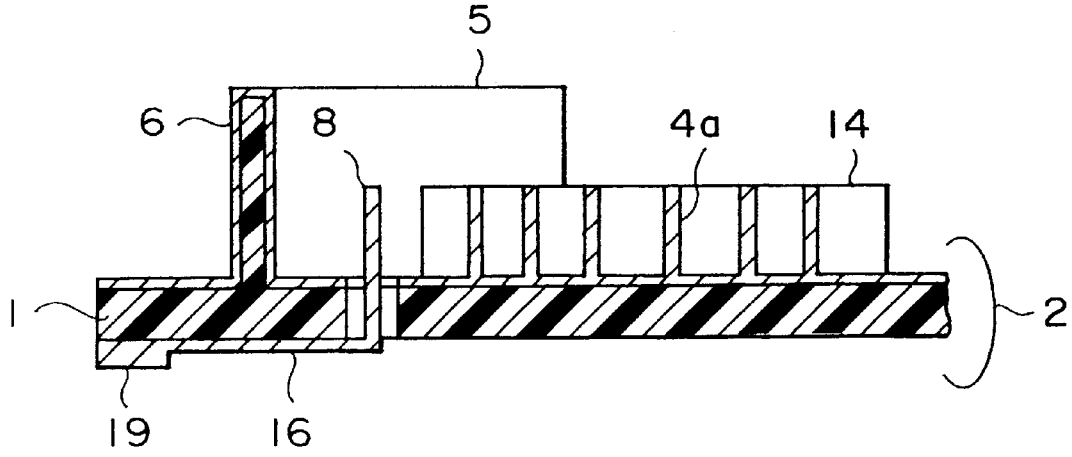

FIGS. 5A and 5B show the second embodiment according to the present invention, and FIG. 5A is a perspective view while FIG. 5B is a sectional view. These figures shows an example in which parasitic elements are formed as metallic strip films at one face of a dielectric plate. In the figures, reference numeral 1 indicates a dielectric plate, reference numeral 2 indicates a ground plane (or plate, and being fan-shaped in this example), and reference numeral 5 indicates fin(s). In addition, reference numeral 6 indicates a reflector, reference numeral 8 indicates pole radiator(s), reference numeral 14 indicates dielectric plate(s) forced out from dielectric plate 1 as being perpendicular to the plate 1, reference numerals 4*a* indicate parasitic elements formed as strip-shaped metallic coats, reference numeral 16 indicates a strip line provided on the back face of ground plane 2, and reference numeral 19 indicates a sector switch.

In the present example, the dielectric plates 14 are made by forcing out the corresponding areas from dielectric plate 1. However, another method may be performed in which pole dielectric plates 14 are made independently of dielectric plate 1 and then dielectric plates 14 are fixed to dielectric plate 1. In this case, parasitic elements 4A are glued on the metallic coat of ground plane 2 by using a conductive material such as solder.

In order to form parasitic elements 4*a* as strip metallic coats on dielectric plates 14, or to form a strip line on the back face of ground plane 2, as the present example, a process using a catalyst is performed at the time of plating so as to generate non-plated areas, or an etching process is performed after plating.

In this example, radiators 8 are connected to strip line 16 formed on the back face of ground plane 2 for feeding electricity. In addition, sector switch 19 is also provided on the back face of ground plane 2 so as to switch the sector.

Figure 6A:
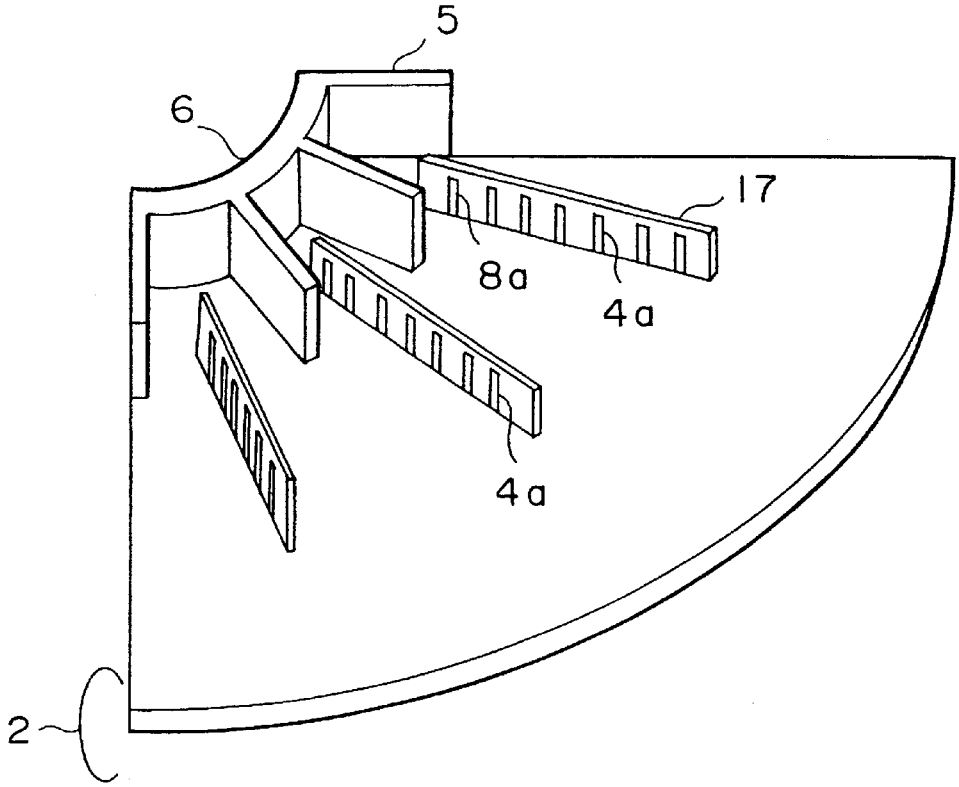
FIGS. 6A and 6B show the third embodiment according to the present invention.
Figure 6B:
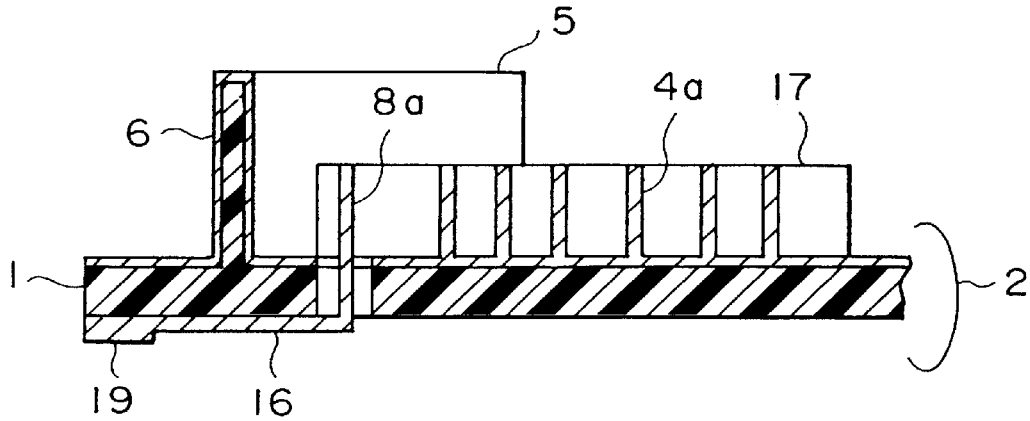

FIGS. 6A and 6B show the third embodiment according to the present invention, and FIG. 6A is a perspective view, while FIG. 6B is a sectional view. This example is almost the same as that shown in FIGS. 5A and 5B, and a different point is that radiator(s) 8*a* are formed on dielectric plate 17 together with parasitic elements 4*a*. All structural features other than this point are the same as those shown in FIGS. 5A and 5B; thus, detail explanations are omitted here.

Figure 7A:
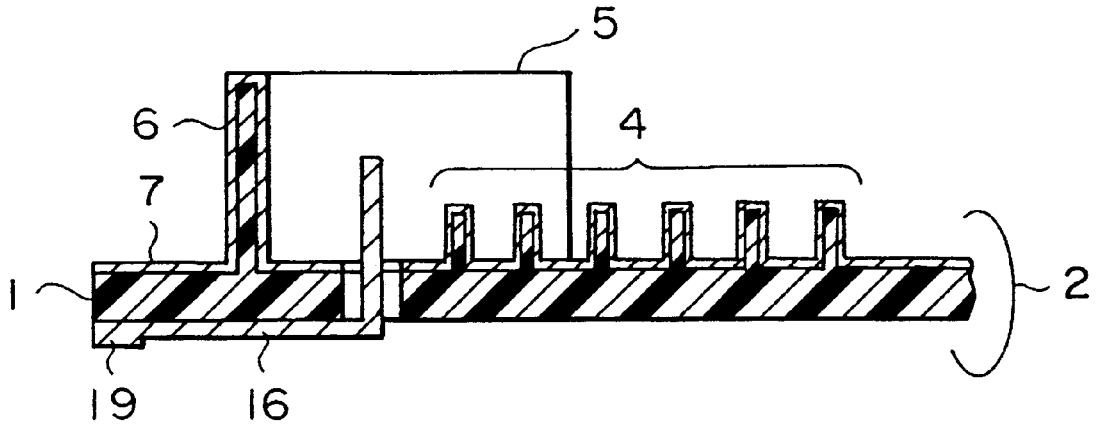
FIGS. 7A and 7B show other two examples as embodiments according to the present invention.
Figure 7B:
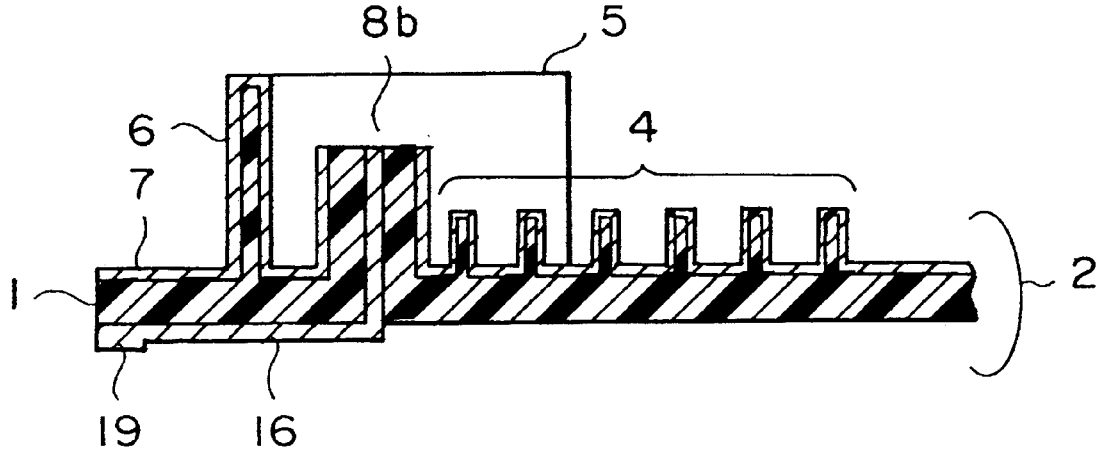

FIGS. 7A and 7B show two other examples as embodiments according to the present invention, and these examples are respectively shown by sectional views in FIGS. 7A and 7B.

The example shown by FIG. 7A is almost the same as that shown in FIGS. 1A and 1B, and a different point is that strip line 16 and sector switch 19 are provided on the back face of ground plane 2.

In the example of FIG. 7B, differences from the example shown by FIG. 7A is that radiator 8*b* is made by forcing out the corresponding portion in dielectric plate 1, coating the surface of the forced-out portion with a metallic coat, making a hole at the center of the portion, and then filling a conductive material into the hole or coating the inner surface of the hole with a conductive coating, so as to feed electricity through strip line 16.

Figure 8A:
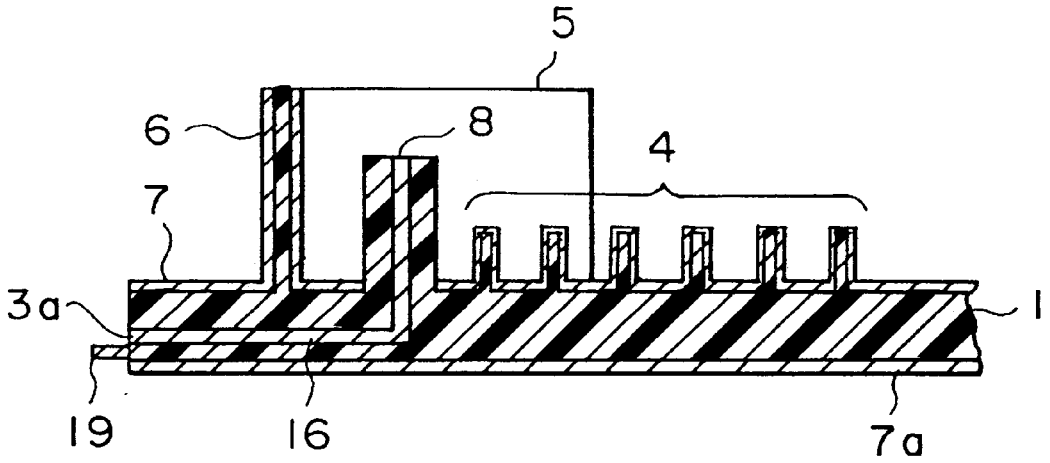
FIGS. 8A and 8B show further another example as an embodiment according to the present invention.
Figure 8B:
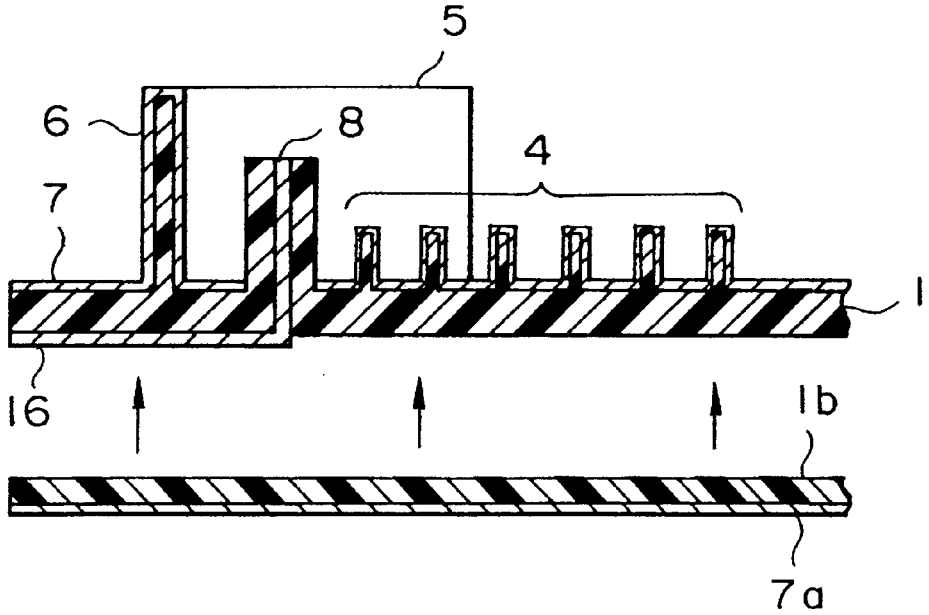

FIGS. 8A and 8B show further another example as an embodiment according to the present invention, in which the strip-line part has a "triplate" structure.

In FIGS. 8A and 8B, reference numeral 8 indicates an inner conductor as a radiator, which is a metal conductor inserted into a dielectric hole. Reference numeral 16 indicates a 50 Ω micro-strip line for feeding radiator 8 and this line passes through the hole of radiator 8 to hole 3*a*.

That is, hole 3*a* is previously provided in dielectric material 1, and the metallic material filled in this hole is connected to radiator 8. As a method for making hole 3*a*, (i) double pattern-draw, (ii) making a hole after single pattern-draw, and inserting metallic conductors from both the hole of radiator 8 and hole 3*a*, or (iii) making upper and lower parts using separate molds and pasting them together, as shown in FIG. 8A, may be used. Here, reference numeral 7*a* indicates a metallic coat functioning as the ground of strip line 16.

Figure 9:
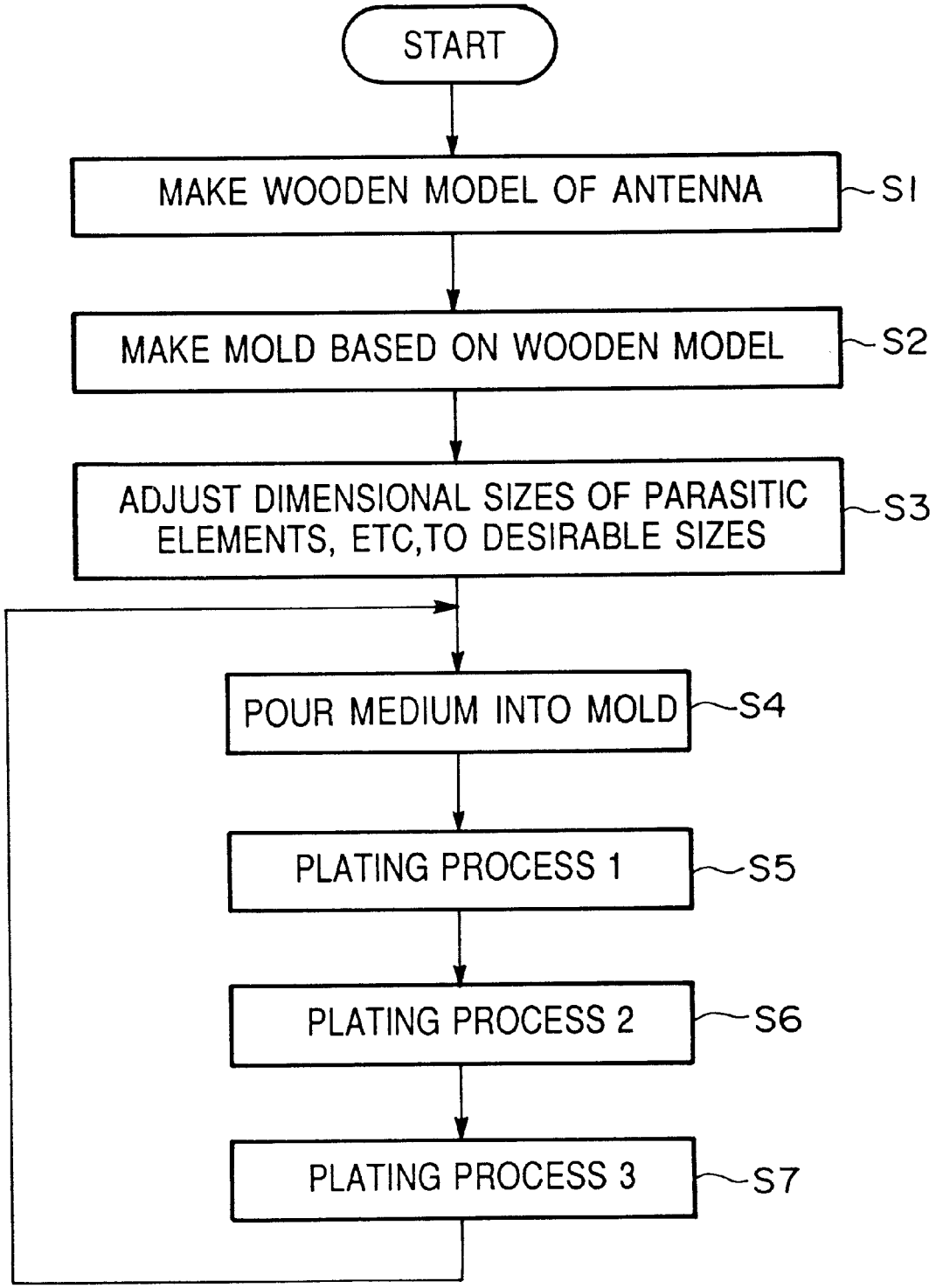
FIG. 9 is an exemplary flowchart of processes for manufacturing the antenna according to the present invention.

FIG. 9 is a flowchart of processes for manufacturing the basic structure of the antenna according to the present invention. As shown in the figure, a wooden model having the same shape as a desirable antenna is made (see step S1), and a corresponding mold is made based on the wooden model (see step S2). Necessary dimensional adjustments are performed when making the mold (see step S3). (Conventionally, such adjustments are performed during the manufacturing of each antenna.) Remaining processes are only casting a medium material (see step S4) and performing plating (see steps S5–S7) regardless of the number of products.

Injection molding by injecting a medium from small holes made in a mold, or compression molding by pouring a medium into one mold and compressing the medium using the other mold, may be adopted as casting using metal mold(s) relating to step S4. Here, injection molding, suitable for manufacturing a fine structure, is preferable because the antenna according to the present invention has a fine structure such as parasitic elements.

Additionally, plating processes in steps S5 to S7 are used for plating of the above-mentioned three layers.

The mold adjustment is performed by measuring a test antenna into which a medium was poured and which was then plated. By using metal mold casting, the time necessary for adjustment can be greatly reduced. No conventional example in which such metal mold casting is applied to manufacturing of monopole antennas is known. The antenna according to the present invention has a structure which can be formed only by pulling a mold toward one direction, and thus can be manufactured using a mold of a simple structure.

In the case of the antenna as shown in FIGS. 3A and 3B, after the plating processes are completed, it is necessary to mount radiators, while in the case of the antenna as shown in FIGS. 4A and 4B, another process for reinforcing parasitic elements or the like is necessary. For the above-mentioned antennas as other examples, some predetermined processes are similarly necessary.

Hereinbelow, experimental results with respect to characteristics of the antenna manufactured according to the above-explained method will be shown.

Figure 10A:
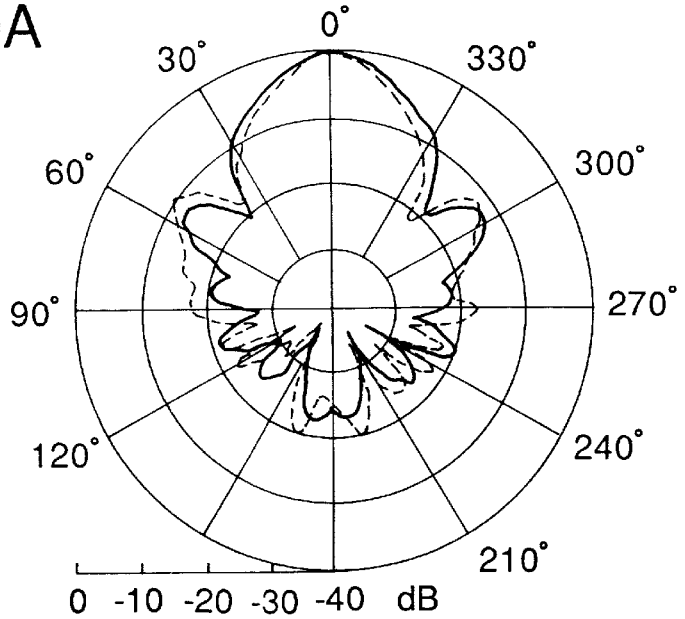
FIGS. 10A and 10B show exemplary radiation pattern of the antenna.
Figure 10B:
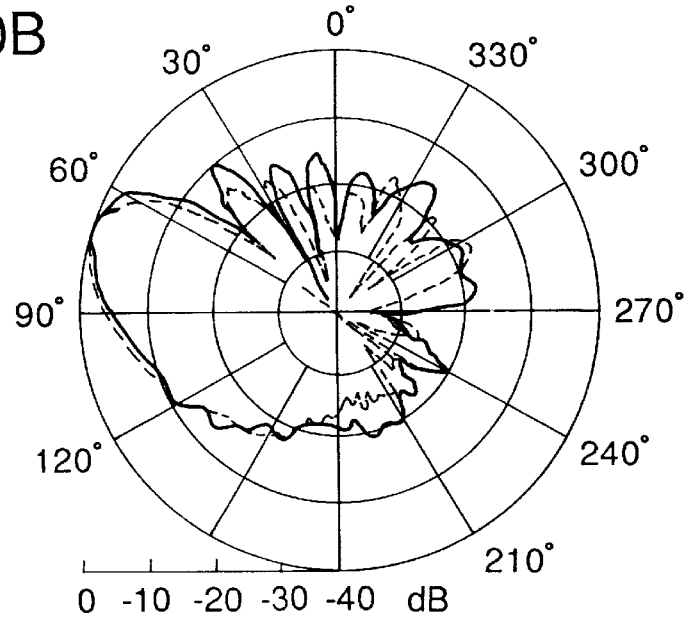

FIGS. 10A and 10B show exemplary radiation pattern at 19.5 GHz of the antenna, and FIG. 10A shows measured data of radiation pattern in a horizontal plane while FIG. 10B shows measured data of radiation pattern in a vertical plane. In the figures, solid lines in the graphs indicate antenna characteristics based on the manufacturing method according to the present invention, while dotted lines indicate antenna characteristics based on a conventional manufacturing method.

With reference to the figures, regarding the antenna manufactured using the manufacturing method according to the present invention, efficiency equal to that obtained by the conventional manufacturing method (in which adjustments of antenna elements are performed for each antenna) can be obtained. Therefore, it is clear that the antenna according to the present invention is suitable for practical use.

Figure 11:
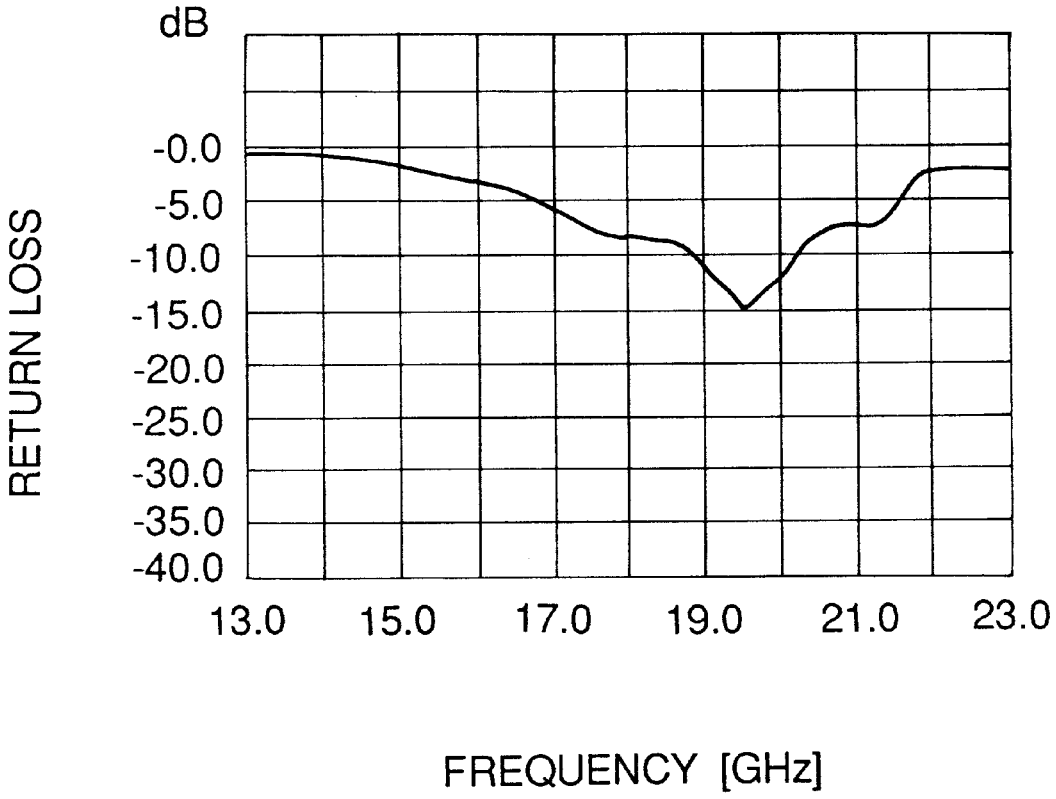
FIG. 11 shows an example of return loss characteristics of the antenna according to the present invention.
Figure 12A:
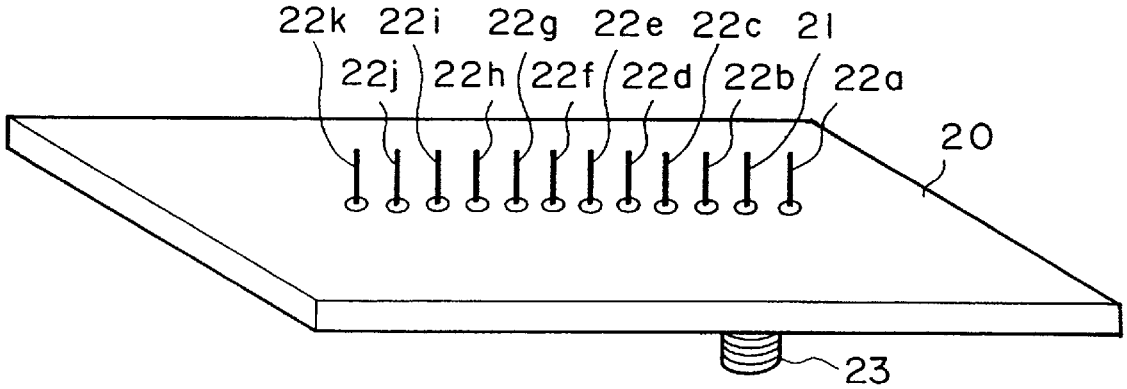
FIGS. 12A and 12B show a monopole array antenna according to the related art.
Figure 12B:
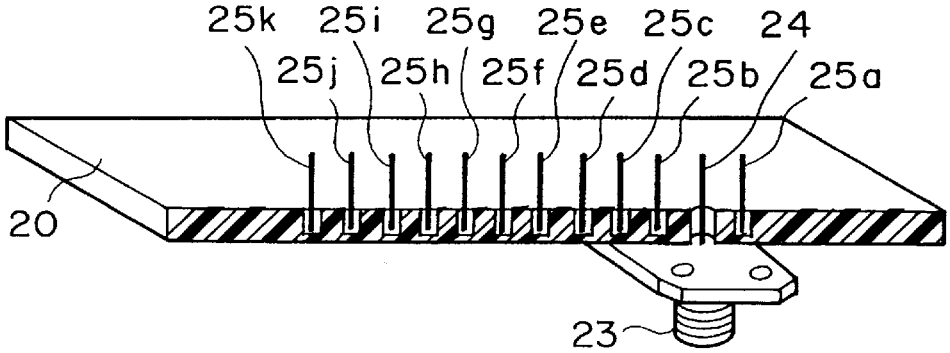

FIG. 11 shows an example of return loss characteristics of the antenna according to the present invention. Generally required level of return loss is −10 dB or less, and FIG. 11 shows that such a requirement is satisfied at 19.5 GHz for which standardization is in progress.

Accordingly, with reference to FIGS. 10 and 11, it is clear that the antenna according to the present invention can realize desirable characteristics with respect to gain, radiation pattern, and return loss, as those realized by conventional manufacturing methods.

As explained above, according to the present invention, a corner reflector multi-sector antenna can be easily realized by simple processing such that the surface of a molded dielectric material is coated with a metallic film. A necessary mold used in this case has a simple structure in which concave portions corresponding to projecting members are provided toward one direction, and thus such a mold can be prepared economically.

In addition, the mold and the dielectric material as a main body of the antenna formed using said mold can be easily separated in a single direction after molding; thus, manufacturing with a good yield rate can be realized.

Therefore, the present invention has an advantage such that highly-accurate antennas can be manufactured very economically.

Furthermore, according to the present antenna having the above-explained structure, a Yagi-Uda antenna with pole-shaped and metallically-coated elements as parasitic elements can be realized as shown in FIGS. 5A, 5B and FIGS. 6A, 6B.

The present invention realizes not only exact directionality by using parasitic elements but also suppression of unnecessary reradiation from a radiator belonging to the next array by providing a fin, and further realizes a low-profile and sharpen beam antenna by efficiently using mutual interaction between adjacent arrays.

Furthermore, the antenna according to the present invention is manufactured by casting a dielectric material into a mold by using the injection or compression molding method, and by coating the surface of the molded dielectric material by using a plating or sputtering method. Therefore, it is unnecessary to bury each element into a hole and to adjust the height thereof, which is necessary in the conventional technique, and by using a previously-formed, highly accurate mold, antennas having the same level of accuracy can be manufactured.

Also as described above, no concave or convex portion exists (that is, the shape is not changed) in the line of each direction perpendicular to the ground plane; thus, the mold is pulled only toward one direction and only one mold is sufficient to manufacture antennas.

The ground plane of the antenna according to the present invention may be of any shape. If a basic construction in which the ground plane is circular is adopted so as to form a 12-sector antenna array, the antenna may be installed at the window. Regarding this basic construction, the following arrangements are also possible: (i) if half of the 12 sectors is not used, the antenna may be modified to be semicircular, and (ii) if the antenna is installed in a corner of a room, quarter-circular antennas may be combined so as to form a circular antenna. Accordingly, installation and combination are flexible in the present invention. In addition, the basic shape of the ground plane is not limited to be circular, but the basic shape may also be a polygon. Similarly, the arc of a semicircular or fan-shaped antenna may be polygonal. Furthermore, a portion where a reflector is provided has not only a cylindrical shape or a board shape obtained by cutting off a part of a side wall of a cylinder, but also a polygonal face, which contacts with the ground plane, in accordance with the number of sectors.

If an inner conductor of a semi-rigid cable is used as a radiator, it is possible to omit a process for establishing a connection between an antenna element and a semi-rigid cable and further to a connector, which is necessary for manufacturing a conventional monopole antenna.

If radiators or parasitic elements are covered with a hardening dielectric material, these small elements can be reinforced and strengthened, and can also be protected from the surroundings. In this way, the characteristics of the antenna can be stably maintained for a long time.

On the other hand, by providing a strip line on the back face of a dielectric material as the ground plane, connection of an antenna element to a feeder circuit or a sector switch can be established via the strip line; thus, a connector, semi-rigid cable, or another feeder circuit can be omitted.

Antenna (system) having a distinctive strip line

Hereinbelow, embodiments of a similar antenna having a structure for easy manufacturing, in which the strip line connected to a radiator is inventive, will be explained. First, problems relating to the strip line in the related art will be shown. After that, embodiments of an antenna for solving the problems, which has a distinctive strip line, will be explained.

Figure 23A:
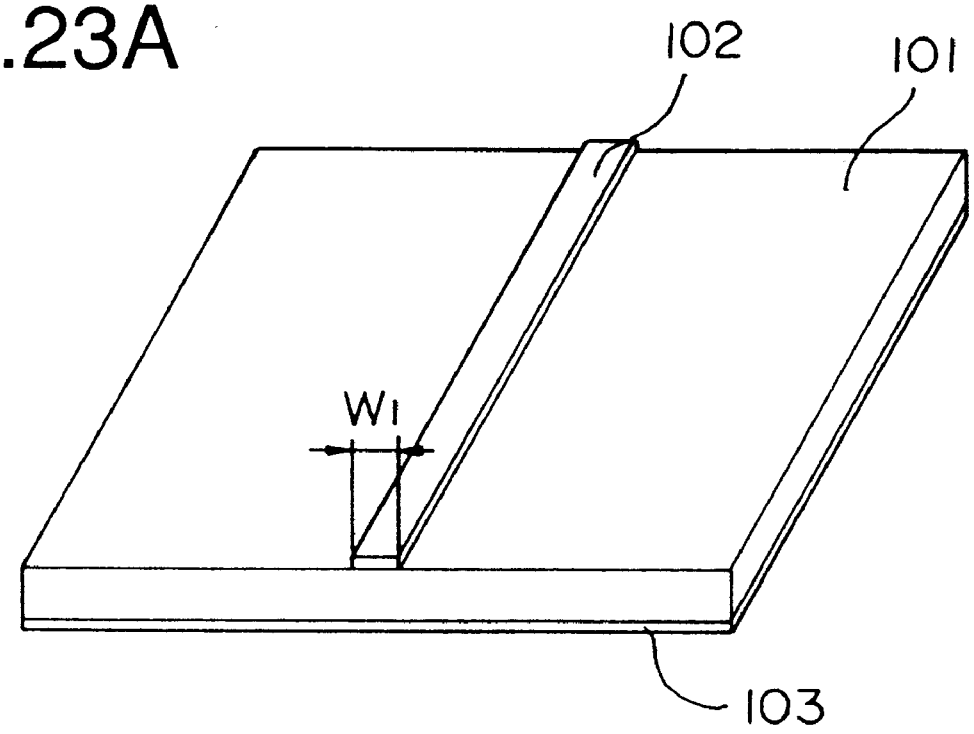
FIGS. 23A and 23B show an arrangement of a strip line in the related art.
Figure 23B:
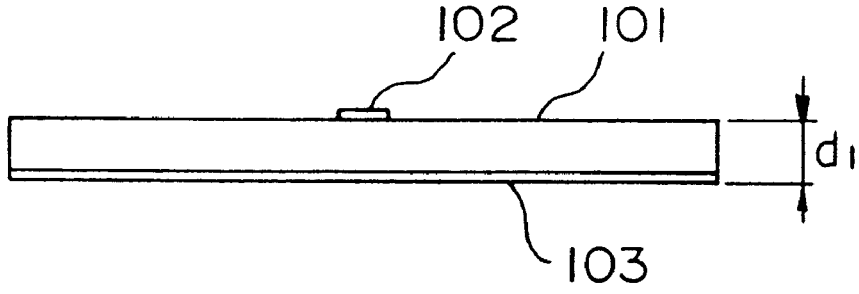

FIG. 23A is a perspective view showing an arrangement of a strip line in the related art, and FIG. 23B is a side view showing the arrangement of the strip line. In FIGS. 23A and 23B, reference numeral 101 indicates a board-shaped dielectric material having a thickness of d1. The relative dielectric constant of the dielectric material 101 is $\epsilon r$, here. Reference numeral 102 indicates a strip conductor formed as a thin film on the surface of dielectric material 101, and the width of the strip conductor is defined as W1. Reference numeral 103 indicates a ground plane formed as a thin film over the whole back face of dielectric material 101, which functions as the ground of strip conductor 102.

In the above structure, if characteristic impedance Z relating to the strip line is approximated using a quasi TEM wave, then, with magnetic permeability $\mu$, relative dielectric constant $\epsilon r$, dielectric constant $\epsilon 0$ in vacuum, and thickness d1 of dielectric material 101, and with width W of strip conductor 102, the characteristic impedance is represented by the following equation (1).

$$Z=((\mu/\epsilon r\cdot\epsilon 0)^{1/2})\cdot(d1/W1[\Omega] \quad (1)$$

Here, with reference to FIGS. 24A–24C, influences on the above-mentioned characteristic impedance Z, caused by a dielectric material whose thickness is non-uniform, will be explained.

Figure 24A:
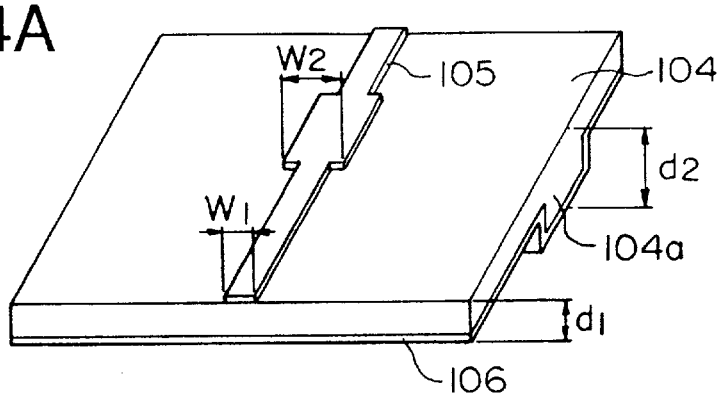
FIGS. 24A–24C show arrangements of a strip line in the related art.

In FIG. 24A, reference numeral 104 indicates a dielectric material having two kinds of thickness, d1 and d2, and projecting portion 104*a* is formed on the back face thereof.

That is, dielectric material 104 is formed such that the thickness of projecting portion 104*a* is d2 while the thickness of remaining portions except for projecting portion 104*a* is d1. Reference numeral 105 indicates a strip conductor formed as a thin film on the surface of dielectric material 104, in which a portion corresponding to projecting portion 104*a* has width W2, while remaining portions except for the portion of width W2 has width W1(<W2). Reference numeral 106 indicates a ground plane formed as a thin film over the whole back face of dielectric material 104.

Here, dielectric material 104 and strip conductor 105 are respectively formed as satisfying a condition: d1/W1=d2/W2. If this condition is satisfied, characteristic impedance Z satisfying the above equation (1) can be obtained over the whole strip line. However, regarding the strip line as shown in FIG. 24A, the thickness of dielectric material 104 is suddenly changed from d1 to d2; thus, reflection and loss of microwaves as transmission media is generated.

Figure 24B:
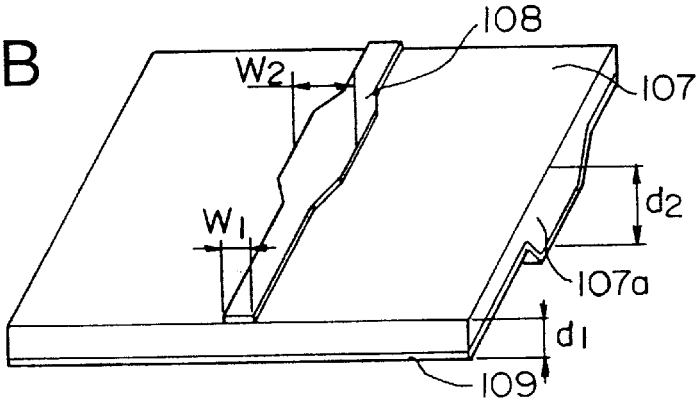

A strip line as shown in FIG. 24B is effectively used in order to reduce such reflection and loss of microwaves. In FIG. 24B, reference numeral 107 indicates a dielectric material having two kinds of thickness of d1 and d2, and on the back face of the dielectric material, taper-shaped projecting portion 7*a* is formed. That is, dielectric material 107 is formed such that the thickness is gently changed from d2 (of remaining portion except for projecting portion 107*a*) to d1 (of projecting portion 107*a*).

Reference numeral 108 indicates a strip conductor formed as a thin film on the surface of dielectric material 107, in which the width corresponding to projecting portion 7*a* is W2 and in the remaining portions except for the portion of width W2, taper-shaped areas are formed so that the width can be gently changed from W2 to W1(<W2). Reference numeral 109 indicates a ground plane formed as a thin film over the whole back face of dielectric material 107.

In the above structure, both dielectric material 107 and strip conductor 108 are taper-shaped; thus, reflection and loss of microwaves at projecting portion 7*a* is reduced.

Hereinbelow, influences on the characteristic impedance Z, caused by very thick projecting portion 104*a* (thickness: d2) of dielectric material 104 (as shown in FIG. 24A), will be explained with reference to FIG. 24C.

Figure 24C:
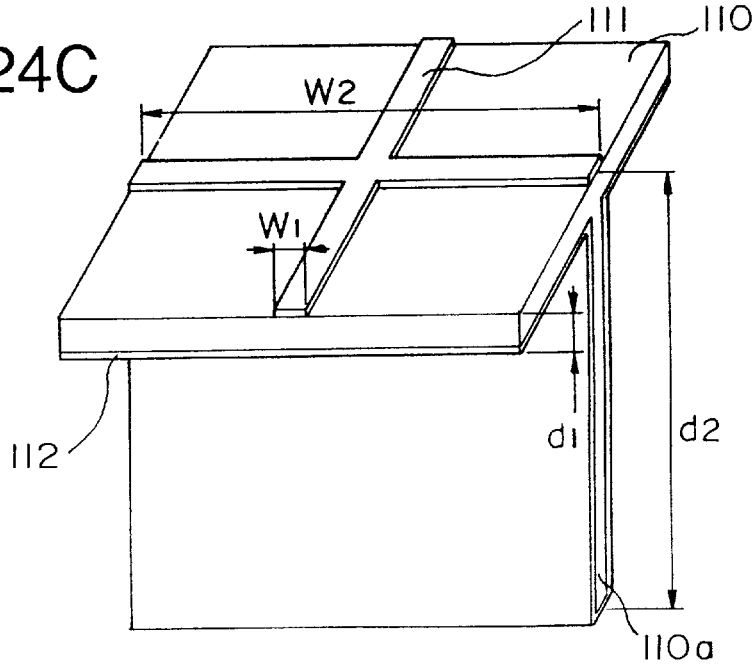

In FIG. 24C, reference numeral 110 indicates a dielectric material having two kinds of thickness of d1 and d2, and projecting portion 110*a* is formed on the back face of the dielectric material. Here, thickness d2 shown in FIG. 24C is very large in comparison with corresponding thickness d2 in FIG. 24A. Reference numeral 111 indicates a strip conductor formed as a thin film on the surface of dielectric material 110, in which the width of a portion corresponding to projecting portion 110*a* is W2, and the width of remaining portions except for the portion of width W2 is W1(<W2).

Here, width W2 shown in FIG. 24C is very large in comparison with width W2 shown in FIG. 24A. Reference numeral 112 indicates a ground plane formed as a thin film over the whole back face of dielectric material 110.

In the above structure, the portion of width W2 in strip conductor 111 has the very large thickness of d2; thus, ground plane 112 at the opposite side of the portion of width W2 does not function as the ground. Therefore, in the strip line as shown in FIG. 24C, the above assumption using a quasi TEM wave cannot be applied; thus, uniform characteristic impedance Z cannot be obtained over the whole strip line.

Accordingly, in the strip line as shown in FIG. 24C, reflection and loss of microwaves is remarkably increased in comparison with the strip line as shown in FIG. 24A.

Figure 25A:
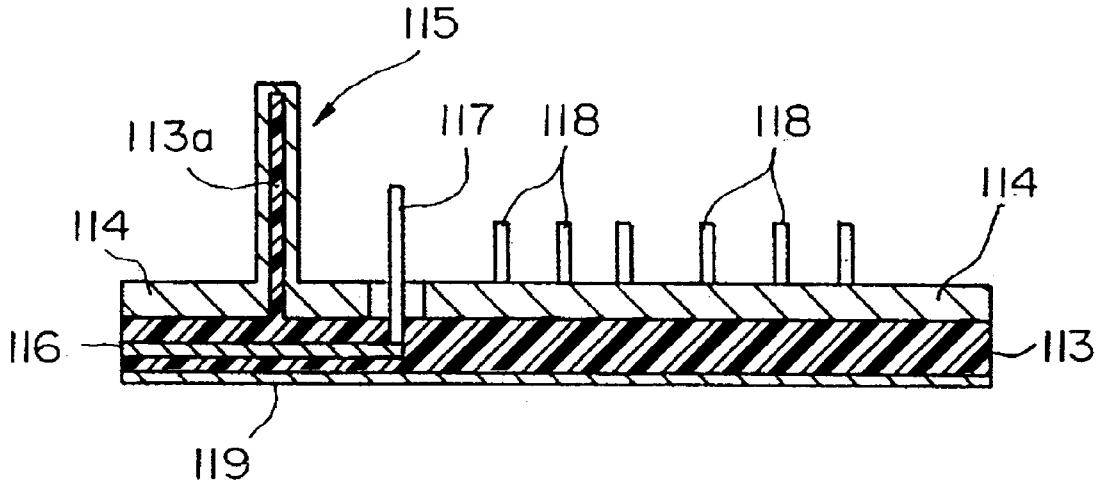
FIGS. 25A and 25B are side sectional views showing the structure of an antenna using a strip line in the related art.
Figure 25B:
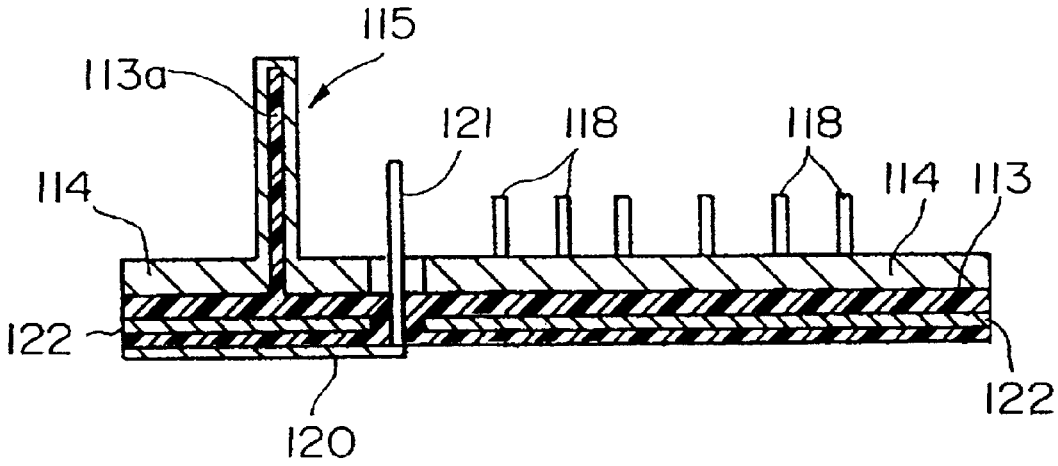

FIGS. 25A and 25B are side sectional views showing the structure of an antenna using a strip line. The antenna as shown in these FIGS. 25A and 25B functions as a monopole Yagi-Uda antenna (or a monopole array antenna).

In FIG. 25A, reference numeral 113 indicates a board-shaped dielectric material, on the surface of which, projecting portion 113*a* is formed. Reference numeral 114 indicate a ground plane provided by coating the whole surface of dielectric material 113 (including projecting portion 113*a*) with a thin film of a conductor. This ground plane functions as the ground for antenna element 117 which is explained later. Projecting portion 113*a* and ground plane 114 which is formed as a thin film on the surface of the projecting portion 113*a* function as reflecting plate 115 of antenna element 117. Here, both "antenna element" and "radiator" have the same meaning.

Reference numeral 116 indicates a strip conductor, buried inside the dielectric material 113 and along ground plane 114. Antenna element 117 is mounted in front of (i.e., in FIG. 25A, at the right side of) reflecting plate 115. The lower end of the antenna element is electrically connected to an end of strip conductor 116, and the element 117 is also vertically provided in dielectric material 113. Here, both "reflecting plate" and "reflector" have the same meaning. Reference numerals 118, 118, . . . indicate plural parasitic elements disposed in a line, in front of (i.e., in FIG. 25A, at the right side of) antenna element 117. Reference numeral 119 indicates a ground plane which is made by coating the whole back face of dielectric material 113 with a thin film, and which functions as the ground for strip conductor 116.

In FIG. 25A, reflecting plate 115 does not function as a ground plane, as explained with reference to FIG. 24C; thus, a "triplate" structure in which ground planes 119 and 114 are respectively provided for strip conductor 116 and antenna element 117 is adopted here.

Next, with reference to FIG. 25B, another example of the structure of an antenna using a strip line will be explained. In FIG. 25B, parts identical to those in FIG. 25A are given identical numbers, and explanations thereof are omitted. In FIG. 25B, strip conductor 120, antenna element 121, and ground plane 122 are provided instead of strip conductor 116, antenna element 117, and ground plane 119 as shown in FIG. 25A.

Strip conductor 120 is formed as a thin film dielectric material on the back face of dielectric material 113 and below the reflecting plate 115. Antenna element 121 is mounted in front of reflecting plate 115, and the lower end of element 121 is electrically connected to an end of strip conductor 120 and the element 121 is vertically provided in dielectric material 113. Ground plane 122 is generally buried inside the dielectric material 113 and along ground plane 114.

That is, in comparison with the structure as shown in FIG. 25A in which ground plane 119 is placed below strip conductor 116, in FIG. 25B, ground plane 122 is placed above strip conductor 120.

Here, in Fig. 25B, reflecting plate 115 does not function as a ground plane, as in the case shown by FIG. 25A; thus, a "triplate" structure in which ground planes 122 and 114 are respectively provided for strip conductor 120 and antenna element 121 is adopted here.

In such strip lines, if the thickness of projecting portion 110*a* of dielectric material 110 is very large as shown in FIG. 24C, the part of ground plane 112 corresponding to projecting portion 110*a* does not function as the ground with respect to strip conductor 111. Accordingly, when a dielectric material having a projecting portion is used, it is difficult to manufacture a strip line which includes a very thick projecting portion and which has very little reflection and loss of microwaves.

In the antenna using a strip line, as explained with reference to FIG. 25A and 25B, a triplate structure is necessary for such a case in which dielectric material 113 including very thick projecting portion 113*a* is used, based on the reasons as described above. Therefore, regarding the antenna using a strip line, plural molds are necessary for manufacturing and thus manufacturing processes are complicated.

In consideration of such a problem, plural embodiments relating to a strip line and an antenna using the strip line, in which reflection and loss of microwaves can be reduced even though a dielectric material including a very thick projecting portion is used and manufacturing processes can be simplified, will be shown and explained, hereinbelow.

First embodiment relating to distinctive strip line

Figure 13:
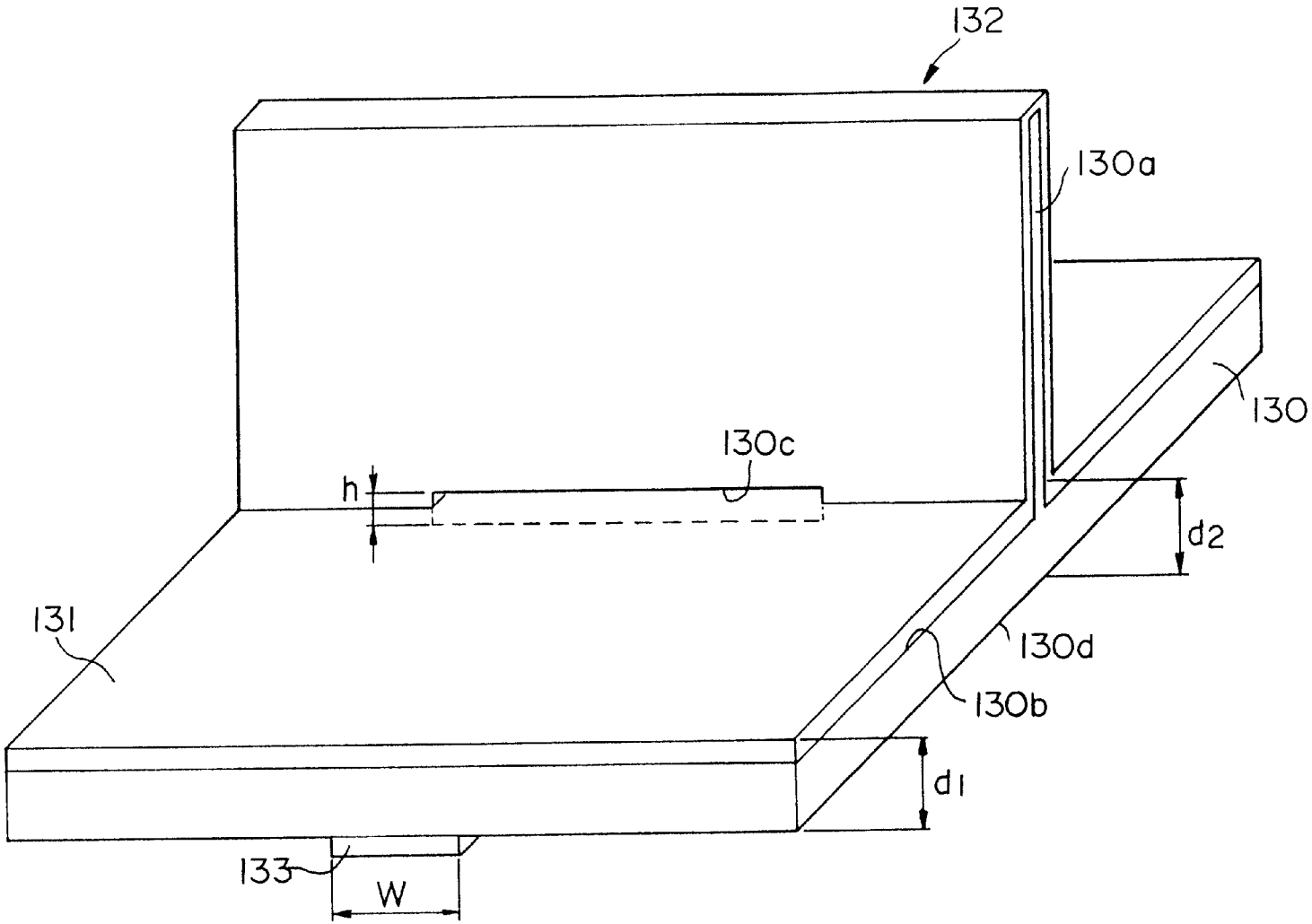
FIG. 13 is a perspective view showing a structure of a distinctive strip line of the first embodiment according to the present invention.

Hereinafter, each embodiment will be explained with reference to the drawings. FIG. 13 is a perspective view showing a structure of a strip line of the first embodiment according to the present invention.

In this figure, reference numeral 130 indicates a board-shaped dielectric material, and the thickness thereof is d1. On the surface 130*b* of dielectric material 130, upward projecting portion 130*a* is formed along a transverse direction in the figure.

Reference numeral 130*c* indicates a through hole, formed at a center part of the base of projecting portion 130*a*, in the transverse direction, this hole passing from the surface to the back face of projecting portion 130*a*. The lower face of this through hole 130*c* and upper face (or surface) 130*b* of dielectric material 130 are coplanar.

In addition, the distance from surface 130*b* of dielectric material 130 to the upper edge of through hole 130*c*, that is, the height of through hole 103*c*, is defined as "h". This height h is 0.1, or preferably 0.05, times as much as the wavelength of a microwave as a transmission medium. The preferable condition that the height is 0.05 times as much as the wavelength of the microwave is defined because under this condition, the action of the microwaves with respect to projecting portion 130*a* is similar to that observed in the case in which through hole 130*c* is not provided. If satisfactory antenna capability is the only requirement, height h may be 0.1 times as much as the wavelength of the microwaves. In addition, the above height h may be suitably changed according to specification changes or the like.

Reference numeral 131 indicates a ground plane formed as a thin film dielectric material over the whole surface 130*b* of dielectric material 130 and also the whole outer faces of projecting portion 130*a*, the ground plane functioning as ground. In the figure, "d1" (the thickness of dielectric material 130) also includes the thickness of ground plane 131; however, the thickness of ground plane 131 is assumed to be "0", here. Additionally, ground plane 131 is also provided at an area corresponding to through hole 130*c*, on the surface 130*b* of dielectric material 130.

If a strip line is used as a part of an antenna, projecting portion 130*a* and (thin film) ground plane 131 formed over the whole projecting portion 130*a* function as reflecting plate 132.

Strip conductor 133 is formed as a thin film dielectric material on the back face 130*d* of dielectric material 130, in a longitudinal direction in the FIG. 13, and width W of the line is smaller than the width of through hole 130*c*. Additionally, the width W of strip conductor 133 is fixed from the front end to the rear end (in the figure), and the thin-film strip conductor 133 is formed on the back face 130*d* of dielectric material 130 in a manner such that through hole 130*c* exists above this strip conductor.

In the above structure, the thickness of dielectric material 130 with respect to strip conductor 133 is d1 over al areas from the front end to the rear end. That is, as through hole 130*c* is formed in projecting portion 130*a*, effective thickness of the part corresponding to through hole 130*c* of dielectric material 130 with respect to strip conductor 133 is d2 equal to d1. Therefore, the thickness of dielectric material 130 with respect to strip conductor 133 can be assumed as "d1" over all areas.

Consequently, according to the strip line in the above-explained first embodiment, even though dielectric material 130 includes very thick projecting portion 130*a* as shown in FIG. 24C, characteristic impedance Z can be fixed over all areas with fixed width W of strip conductor 133.

Therefore, according to the strip line of the above-mentioned first embodiment, reflection and loss of microwaves as transmission media can be reduced if very thick projecting portion 130*a* exists in dielectric material 130.

Second embodiment of antenna having distinctive strip line

Figure 14A:
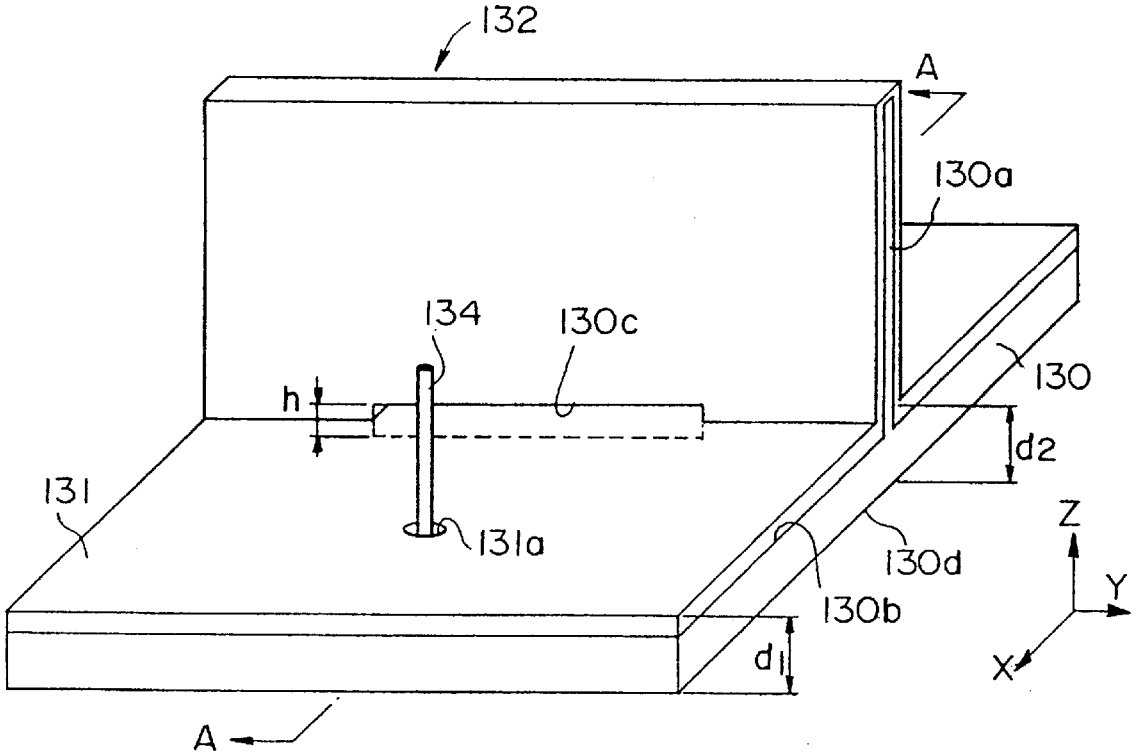
FIGS. 14A and 14B show the structure of an antenna having a distinctive strip line of the second embodiment.

Hereinafter, a structure according to the second embodiment relating to an antenna having a distinctive strip line will be explained with reference to FIGS. 14A and 14B. FIG. 14A is a perspective view showing the structure of the antenna having a strip line of the second embodiment, and FIG. 14B is a sectional view taken along the line A-A' in FIG. 14A.

Figure 14B:
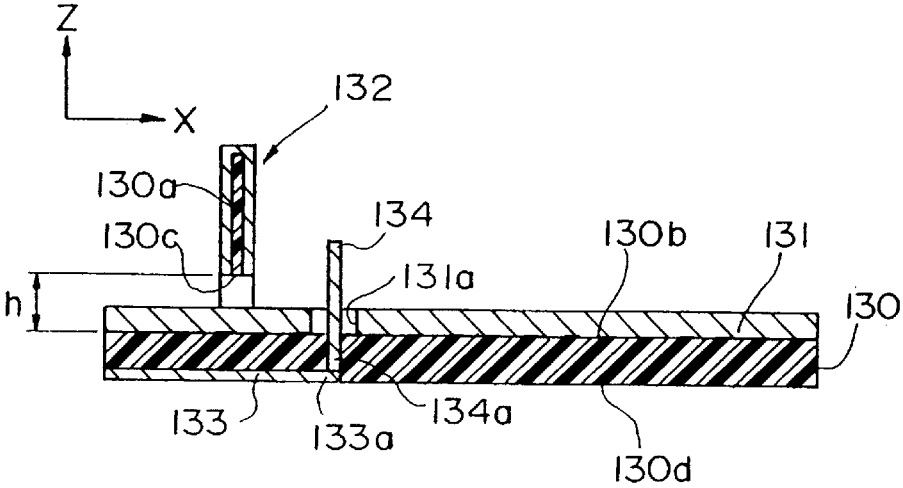

In FIGS. 14A and 14B, parts identical to those in FIGS. 13A and 13B are given identical numbers, and explanations thereof are omitted here.

In FIG. 14A, hole 131*a* is provided in ground plane 131, and antenna element 134 is newly added here. In addition, strip conductor 133 shown in FIG. 14B in formed on the back face 130*d* of dielectric material 130 in a manner such that the length of the strip conductor is shorter than strip conductor 133 shown in FIGS. 13A and 13B, and that the width of the present strip conductor is fixed as "W" over the whole area.

The antenna element 134 as shown in FIG. 14B is vertically provided in dielectric material 130 such as projecting upward from hole 131*a* in ground plane 131, and the lower end of element 134 is electrically connected to end 133*a* of strip conductor 133. In this case, it can be assumed that electrical uniformity is satisfied over the whole area of thickness d1 of dielectric material 130 in FIG. 14A, as described above; thus, ground plane 131 shown in FIG. 14B functions as the common ground for antenna element 134 and strip conductor 133.

In the above structure, when microwaves are supplied to the strip line consisting of dielectric material 130, ground plane 131, and strip conductor 133, the microwave is radiated from antenna element 134. At this time, the radiated microwave has directionality in the positive X-axis direction, via reflecting plate 132.

As explained above, according to the antenna using a strip line in the second embodiment of the present invention, ground plane 131 can be used as the common ground for strip conductor 133 and antenna element 134; thus, the present antenna can be easily manufactured using fewer molds for metal mold casting in comparison with the antenna having the triplate structure as shown in FIGS. 25A and 25B.

Third embodiment of antenna having distinctive strip line

Figure 15:
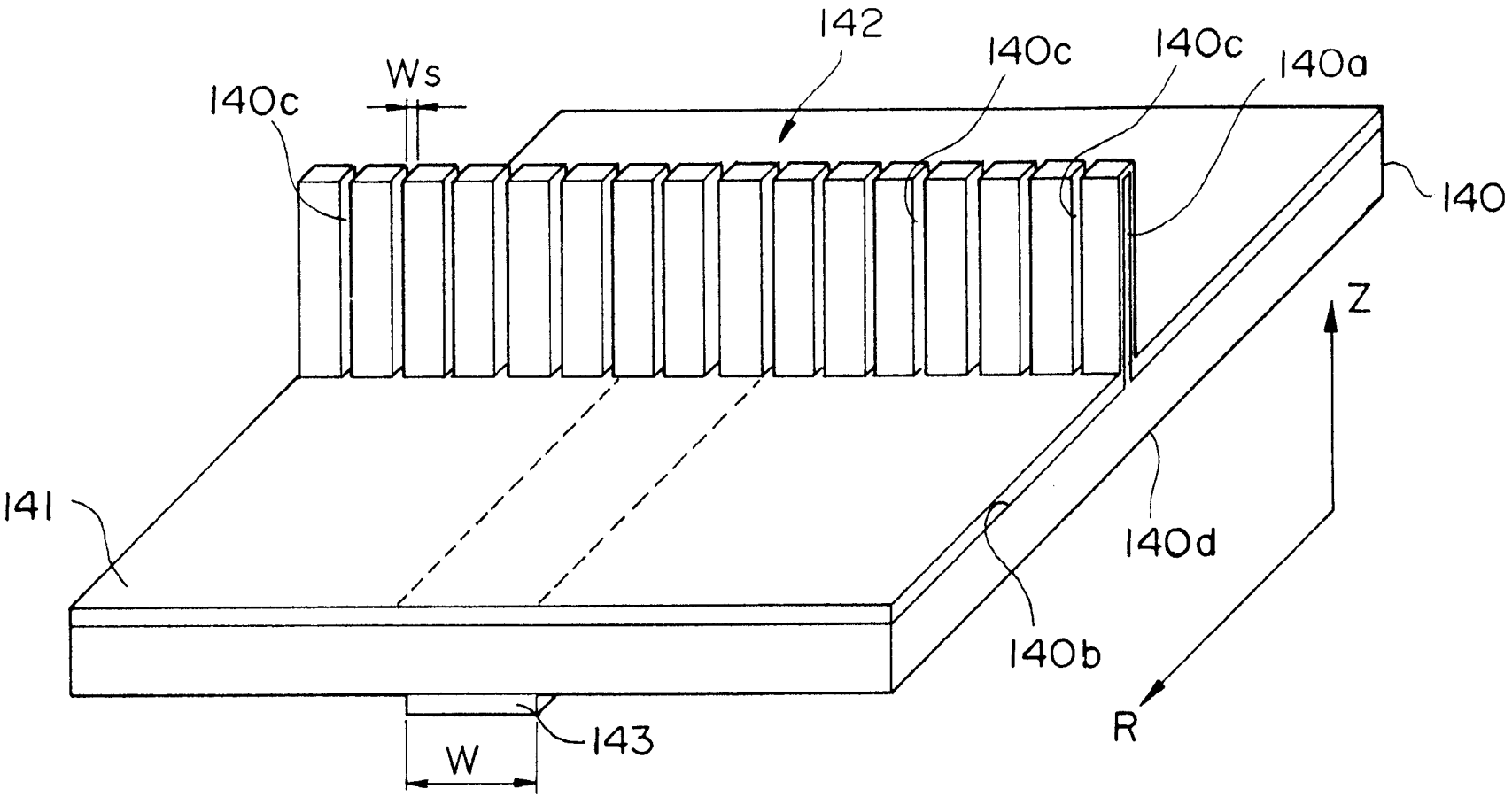
FIG. 15 is a perspective view showing the structure of a distinctive strip line of the third embodiment.

Hereinafter , a structure of a strip line according to the third embodiment will be explained with reference to FIG. 15. FIG. 15 is a perspective view showing the structure of the strip fine of the third embodiment.

In FIG. 15, reference numeral 140 indicates a board-shaped dielectric material, and on the surface 140*b* thereof, upward projecting portion 140*a* is formed in a transverse direction in the figure. In the projecting portion 140*a*, plural slits 140*c*, 140*c*, . . . , slit width being "Ws", are provided from the lower end to the upper end of the projecting section. The above slit width Ws is 0.1, preferably 0.05 times as much as the wavelength of a microwave as a transmission medium. This slit width Ws may be suitably changed according to a specification change or the like.

Reference numeral 141 indicates a ground plane form ed by coating the whole surface 140*b* of dielectric material 140 and the whole projecting portion 140*a* (having slits 140*c*, 140*c* . . .) with a thin film. This ground plane functions as the ground for strip conductor 143 which is explained later.

If a strip line is used as a part of an antenna, projecting portion 140*a* and ground plane 141 formed as the thin film over the projecting portion function as reflecting plate 142. Strip conductor 143 is formed by coating the back face 140*d* of dielectric material 140 with a thin film dielectric material in a longitudinal direction in the figure, and width W thereof is fixed from the front end to the rear end. Here, dotted lines in the figure indicate the position of strip conductor 143 provided on back face 140*d*, and thus correspond to projected lines onto the surface of the dielectric material toward the Z direction in the figure. This definition will be used in the following drawings.

In the above structure, plural slits 140*c*, 140*c*, . . . are provided in projecting portion 140*a* of dielectric material 140; thus, it can be assumed that the thickness of dielectric material 140 with respect to strip conductor 143 is fixed from the front to rear ends. This is because plural slits generally suppress influences on electric and magnetic fields, and currents.

Therefore, according to the strip line of the above-explained third embodiment, even though dielectric material 140 including very thick projecting portion 140*a* is used, characteristic impedance Z can be fixed over all areas with strip conductor 143 having fixed width W.

That is, according to the strip line of the above-mentioned third embodiment, reflection and loss of microwaves as transmission media can be reduced even though very thick projecting portion 140*a* is included in dielectric material 140.

The strip line of the above-mentioned third embodiment has a structure which can be manufactured by pulling a mold toward one direction. Therefore, this strip line can be easily manufactured using a single mold.

Fourth embodiment of antenna having distinctive strip line

Figure 16A:
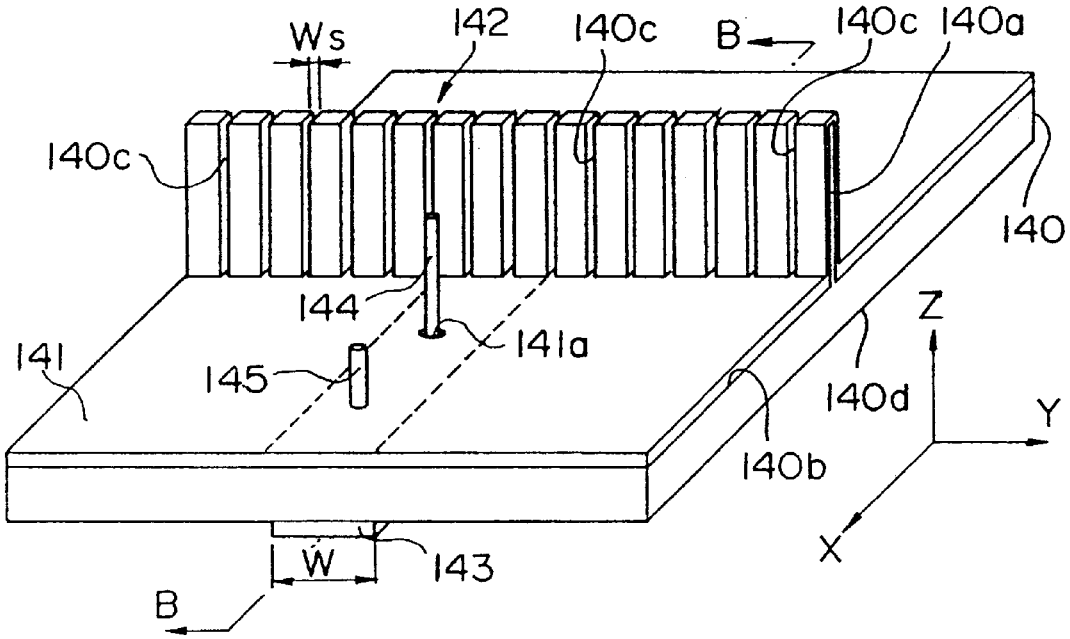
FIGS. 16A and 16B show the structure of an antenna having a distinctive strip line of the fourth embodiment.

Hereinafter, a structure according to the fourth embodiment relating to an antenna having a distinctive strip line will be explained with reference to FIGS. 16A and 16B. FIG. 16A is a perspective view showing the structure of the antenna having a strip line of the fourth embodiment, and FIG. 16B is a sectional view taken along the line B-B' in FIG. 16A.

Figure 16B:
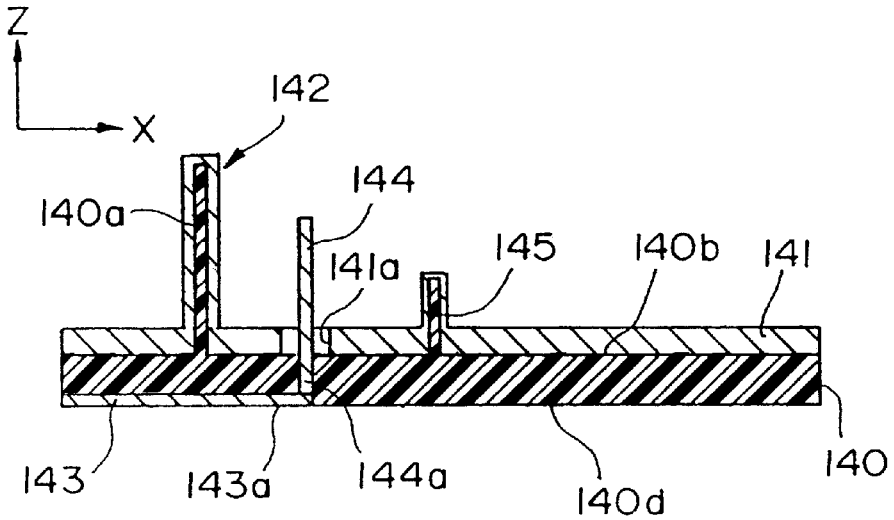

In FIGS. 16A and 16B, parts identical to those in FIGS. 15A and 15B are given identical numbers, and explanations thereof are omitted here.

In FIGS. 16A and 16B, hole 141*a* is provided in ground plane 141, and antenna element 144 and parasitic element 145 are newly added here. The antenna element 144 as shown in FIG. 16B is vertically provided in dielectric material 140 such as projecting upward from hole 141*a* in ground plane 141, and the lower end of element 144 is electrically connected to end 143*a* of strip conductor 143. In this case, it can be assumed that electrical uniformity is satisfied with respect to the thickness over the whole area of dielectric material 140 in FIG. 16A, as described above; thus, ground plane 141 shown in FIG. 16B functions as common ground for antenna element 144 and strip conductor 143. Parasitic element 145 is mounted in front of antenna element 144.

In the above structure, when microwaves are supplied to the strip line consisting of dielectric material 140, ground plane 141, and strip conductor 143, the microwaves are radiated from antenna element 144. At this time, the radiated microwaves have directionality in the positive X-axis direction, via reflecting plate 142 and parasitic element 145.

Also in the above structure, slit width Ws of slits 140*c*, 140*c*, . . . is 0.1 times as much as the wavelength of the microwave; thus, reflecting plate 142 can be electrically assumed as a reflecting plate without slits.

As explained above, according to the antenna using a strip line in the fourth embodiment of the present invention, ground plane 141 can be used as the common ground for strip conductor 143 and antenna element 144; thus, the present antenna can be easily manufactured using fewer molds for metal mold casting in comparison with the conventional antenna having a triplate structure.

Fifth embodiment of antenna having distinctive strip line

Figure 17:
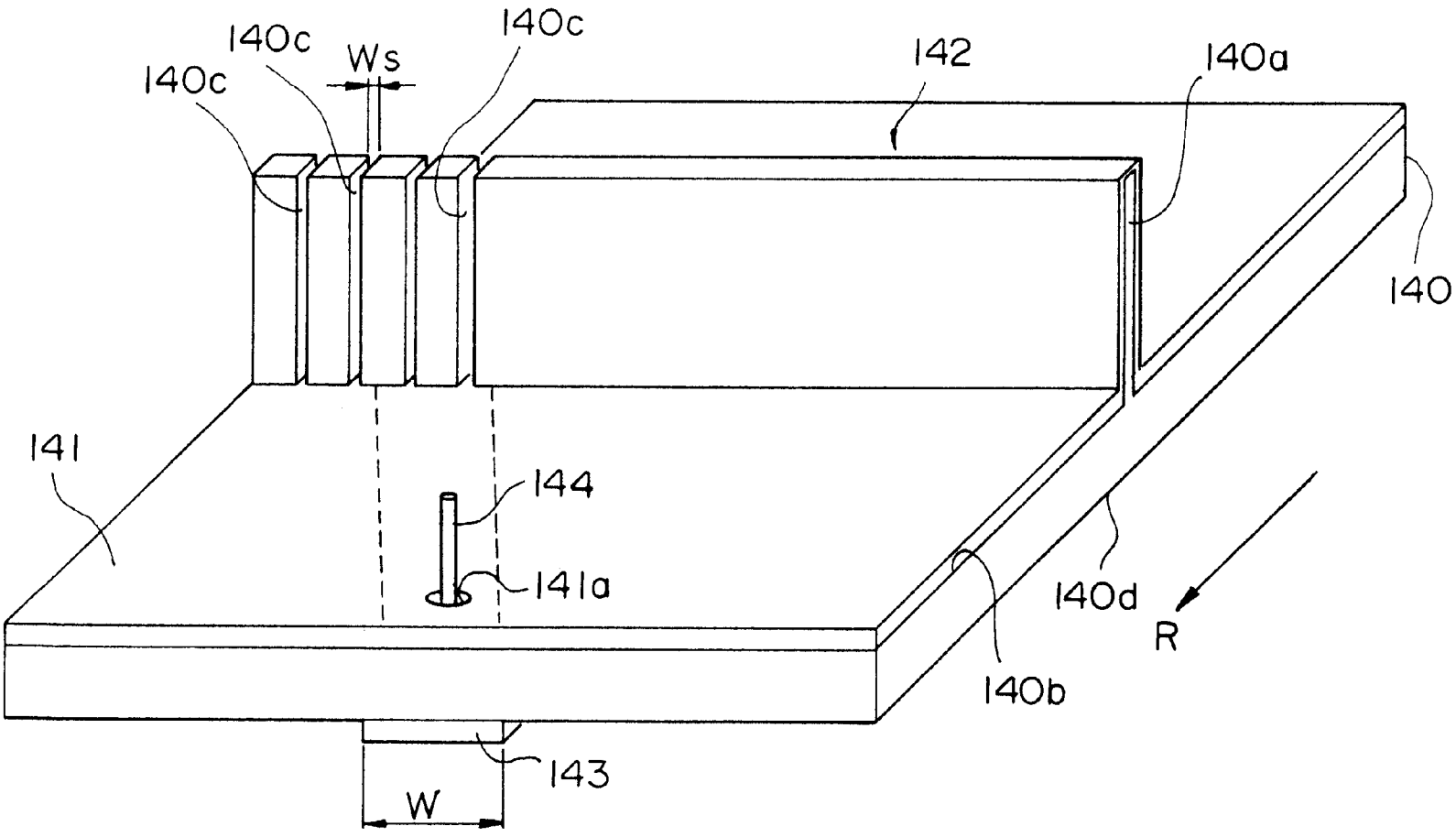
FIG. 17 shows the structure of an antenna having a distinctive strip line of the fifth embodiment.

Hereinafter, a structure according to the fifth embodiment relating to an antenna having a distinctive strip line will be explained with reference to FIG. 17. FIG. 17 is a perspective view showing the structure of the antenna having a strip line of the fifth embodiment, and in this figure, parts identical to those in FIG. 16A are given identical numbers, and explanations thereof are omitted here.

In FIG. 17, the area and the number of slits formed in projecting portion 140*a* of dielectric material 140 are different in comparison with FIG. 16A. and the position of strip conductor 143 is also different. Additionally, in FIG. 17, parasitic element 145 in FIG. 16A is omitted for convenience.

That is, in FIG. 17, four slits 140*c*, 140*c*, . . . are formed only near the left side (face) in the figure, and no slit is provided in the remaining portion. Therefore, in projecting portion 140*a*, slits (140*c*, 140*c* . . . ) do not exist in the portion positioned in an opposite orientation with respect to direction R of the maximum radiation of microwaves radiated from antenna element 144, in other words, in the portion at the rear side of antenna element 144 in the figure.

On the other hand, strip conductor 143 is formed as a thin film below slits 140*c*, 140*c*, . . . on the back face 140*d* of dielectric material 140. That is, the thin-film strip conductor 143 is positioned in a slantwise direction with respect to direction R of the maximum microwave radiation.

According to the above structure, slits 140*c*, 140*c*, . . . are not provided in the portion (of projecting portion 140*a*) in an opposite orientation to direction R of the maximum microwave radiation; thus, influences caused by slits 140*c*, 140*c*, . . . on antenna characteristics can be reduced in comparison with the antenna using a strip line as shown in the fourth embodiment.

Sixth embodiment of antenna having distinctive strip line

Figure 18:
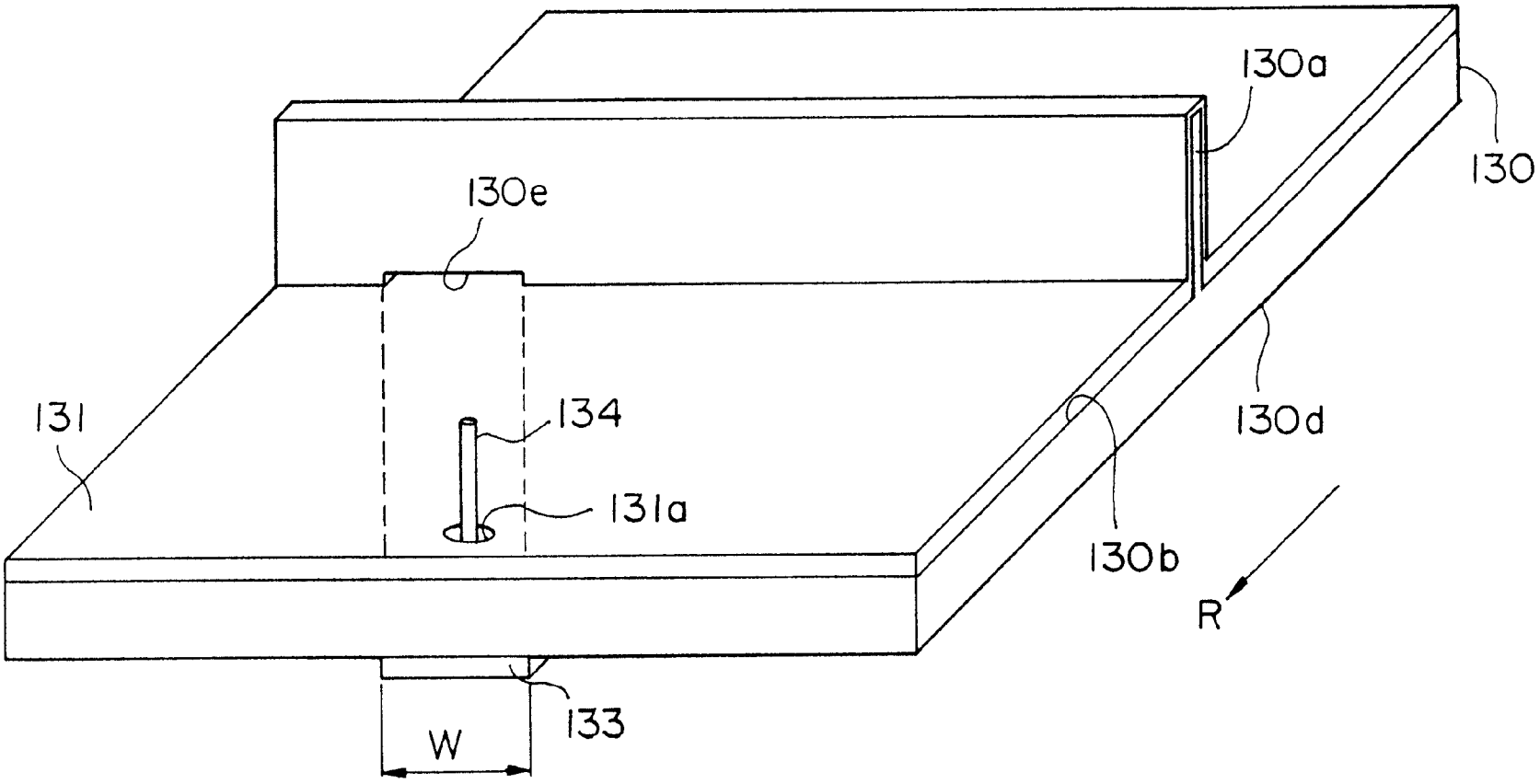
FIG. 18 is a perspective view showing the structure of an antenna having a distinctive strip line of the sixth embodiment

Hereinafter, a structure according to the sixth embodiment relating to an antenna having a distinctive strip line will be explained with reference to FIG. 18. FIG. 18 is a perspective view showing the structure of the antenna having a strip line of the sixth embodiment, and in this figure, parts identical to those in FIG. 14A are given identical numbers, and explanations thereof are omitted here.

In FIG. 18, through hole 130*e* is provided in projecting portion 130*a* instead of through hole 130*c* shown in FIG. 14A, and the position of strip conductor 133 is also different.

That is, through hole 130*e* in FIG. 18 is formed near the left side (face) of projecting portion 130*a* and at a position off to an opposite orientation to direction R of the maximum microwave radiation. In addition, strip conductor 133 is formed as a thin film on back face 130*d* of dielectric material 130 such that the conductor is positioned below through hole 130*e*.

Accordingly, thin film strip conductor 133 is positioned in a slantwise direction with respect to direction R of the maximum microwave radiation, and width W of strip conductor 133 is smaller than the width of through hole 130*e*.

According to the above structure, through hole 130*e* does not exist at a portion (of projecting portion 130*a*) positioned in a direction opposite to direction R of the maximum microwave radiation; thus, influences caused by through hole 130*e* on the antenna characteristics can be reduced in comparison with the antenna using a strip line of the second embodiment.

Seventh embodiment of antenna having distinctive strip line

Figure 19:
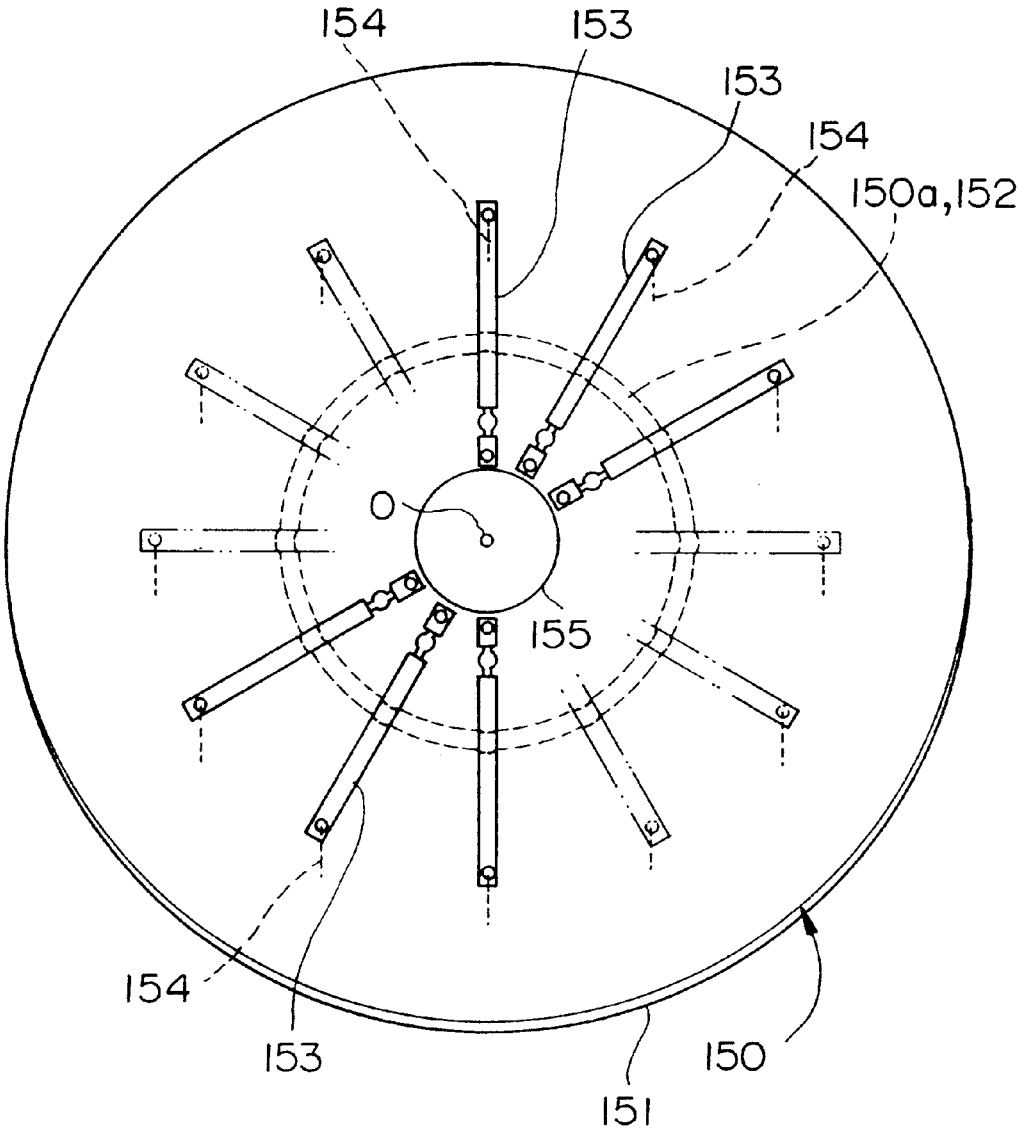
FIG. 19 is a back-face view showing the structure of an antenna having a distinctive strip line of the seventh embodiment.

Hereinafter, a structure according to the seventh embodiment relating to all antenna having a distinctive strip line will be explained with reference to FIG. 19. FIG. 19 is a back-face view showing the structure of the antenna having a strip line of the seventh embodiment.

In FIG. 19, reference numeral 150 indicates a disc-shaped dielectric material, and on the surface thereof (that is, at the back side of this figure), thick-walled cylindrical projecting portion 150*a* is formed. This projecting portion 150*a* has the same structure as that obtained by modifying projecting portion 130*a* (shown in FIG. 14A) or 140*a* (shown in FIG. 16A) to be cylindrical.

In projecting portion 150*a*, through holes (not shown) similar to through hole 130*c* as shown in FIG. 14A are formed at twelve positions with equal spaces in a circumferential line at the base end of the projecting portion. That is, the above plural through holes respectively correspond to plural strip conductors 153, 153, . . . described later. Here, the reason that the through holes are formed at the twelve positions with equal spaces in a circumferential line is that twelve sectors are provided, that is, the number of through holes is determined according to the number of sectors.

Reference numeral 151 indicates a ground plane formed by coating the surface of projecting portion 150*a* of dielectric material 150 with a thin film dielectric material. The projecting portion 150*a* and the thin-film ground plane 151 formed on the projecting portion 150*a* function as reflecting plate 152, as reflecting plate 132 shown in FIG. 14A. Strip conductors 153, 153, . . . are formed as a thin film dielectric material on the back face (i.e., the surface side of FIG. 19) as radiating from center O.

The width of these strip conductors 153, 153, . . . is smaller than the width (i.e., inner diameter) of through holes formed in projecting portion 150*a*. Reference numerals 154, 154, . . . indicate plural antenna elements which are vertically provided at each position corresponding to strip conductors 153, 153, . . . in a manner such that the upper portion of each antenna element projects from the surface of dielectric material 150. The lower portion of each antenna element 154 is electrically connected to one end of each strip conductor 153.

Here, ground plane 151 functions as the common ground for strip conductors 153, 153, . . . and antenna elements 154, 154, . . . similarly to ground plane 131 as shown in FIG. 14A. Reference numeral 155 indicates a sector switch for performing a switching control so as to feed antenna elements 154, 154, . . . .

Operations of the antenna using a strip line of this seventh embodiment are similar to those of the antenna (using a strip line) as shown in FIG. 14A except that feeding states with respect to antenna elements 154, 154,, . . . are controlled and switched by sector switch 155; thus, explanations thereof are omitted.

As explained above, according to the antenna using the strip line in the seventh embodiment of the present invention, ground plane 151 can be used as common ground for strip conductors 153, 153, . . . and antenna elements 154, 154, . . . ; therefore, the present antenna can be easily manufactured with fewer molds for metal mold casting in comparison with the antenna having the triplate structure as shown in FIGS. 25A and 25B.

In the above explanations for the antenna using a strip line of the seventh embodiment, plural through holes are provided at projecting portion 150*a* shown in FIG. 19. However, the embodiment is not limited to such formation, and plural slits may be formed in plural portions on the circumferential face of cylindrical projecting portion 150*a*, as in the case of projecting portion 140*a* shown in FIG. 16A. In this case, similar effects to those obtained by the antenna using a strip line as shown in FIG. 16A can be obtained.

Eighth embodiment of antenna having distinctive strip line

Figure 20:
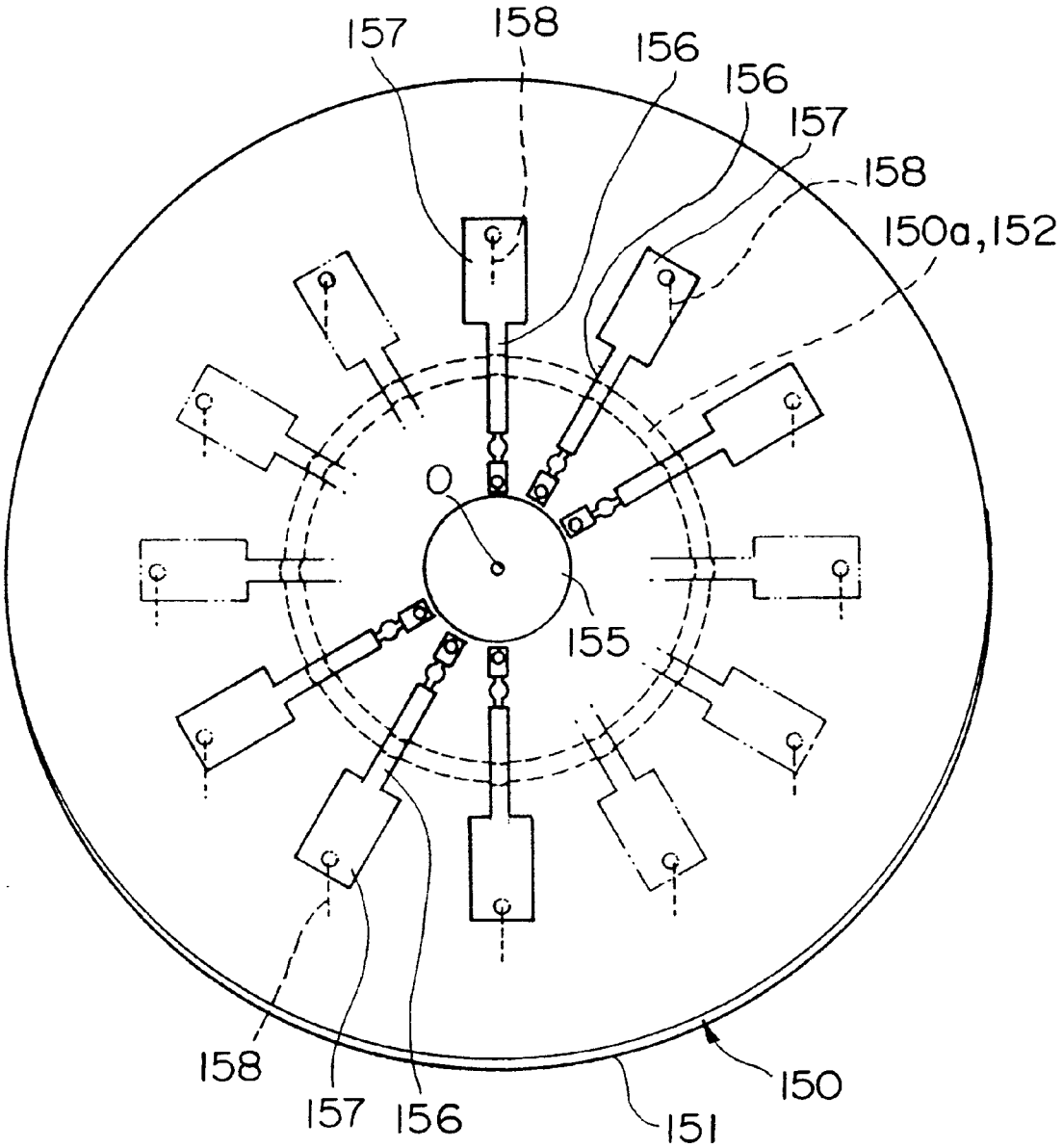
FIG. 20 is a back-face view showing the structure of an antenna having a distinctive strip line of the eighth embodiment.

Hereinafter, a structure according to the eighth embodiment relating to an antenna having a distinctive strip line will be explained with reference to FIG. 20. FIG. 20 is a back-face view showing the structure of the antenna having a strip line of the eighth embodiment.

In FIG. 20, parts identical to those in FIG. 19 are given identical numbers, and explanations thereof are omitted here. In FIG. 20, strip lines 156, 156, . . . , quarter-wave wavelength matching circuits 157, 157, . . . , and antenna elements 158, 158, . . . are provided instead of strip conductors 153, 153, . . . and antenna elements 154, 154, . . .

The strip lines 156, 156, . . . shown in FIG. 20 are formed by coating the back face (i.e., the surface side of this figure) of dielectric material 150 with thin film dielectric materials in a manner such that the strip lines radiate from center O. The width of these strip conductor 156, 156, . . . is smaller than the width of plural through holes formed in projecting portion 150*a*, and the length of the strip conductors is smaller than that of strip conductors 153, 153, . . . as shown in FIG. 19.

Quarter-wave wavelength matching circuits 157, 157, . . . are formed on the back face of dielectric material 150 as extending strip lines 156, 156. . . Reference numerals 158, 158, . . . indicate antenna elements which are vertically provided at each position corresponding to quarter-wave wavelength matching circuits 157, 157, . . . , in a manner such that an upper portion of each antenna element projects from the surface of dielectric material 150. The lower portion of each antenna elements 158, 158, . . . is electrically connected to one end of each quarter-wave wavelength matching circuits 157, 157, . . . . Here, these quarter-wave wavelength circuits 157 are provided so as to establish a matching condition between characteristic resistance of strip line 156 and impedance of antenna element 158 as an end.

On the other hand, ground plane 151 functions as common ground for strip lines 156, 156, . . . , quarter-wave wavelength matching circuits 157, 157, . . . , and antenna elements 158, 158, . . . .

Basic operations of the antenna using a strip line of the eighth embodiment are almost similar to those of the antenna using a strip line of the above-mentioned seventh embodiment; thus, explanations thereof are omitted.

As explained above, according to the antenna using a strip line of the eight embodiment of the present invention, ground plane 151 can be used as common ground for strip lines 156, 156, . . . , quarter-wave wavelength matching circuits 157, 157, . . . , and antenna elements 158, 158, . . . ; thus, the present antenna can be easily manufactured using fewer molds for metal mold casting in comparison with the conventional antenna having the triplate structure.

In the antenna using a strip line of the eighth embodiment, plural slits may be provided instead of plural through holes, in plural portions on the circumferential face of cylindrical projecting portion 150*a*, as in the case of the antenna using a strip line of the seventh embodiment. In this case, similar effects to those obtained by the antenna using a strip line as shown in FIG. 16A can be obtained.

Ninth embodiment of antenna having distinctive strip line

Hereinafter, a structure according to the ninth embodiment relating to an antenna having a distinctive strip line will be explained with reference to FIGS. 21A and 21B.

Figure 21A:
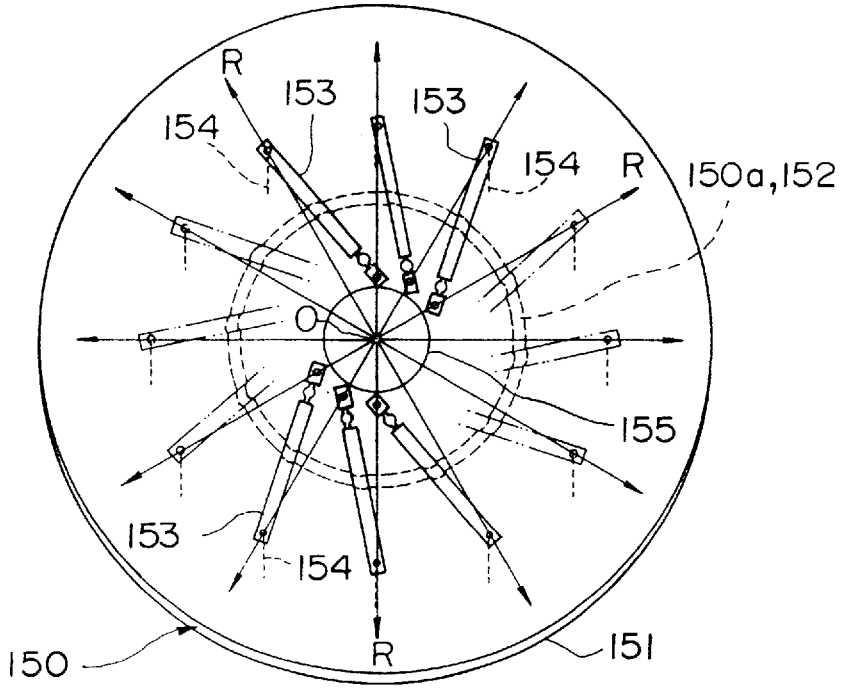
FIGS. 21A and 21B are back-face views showing the structure of an antenna having a distinctive strip line of the ninth embodiment
Figure 21B:
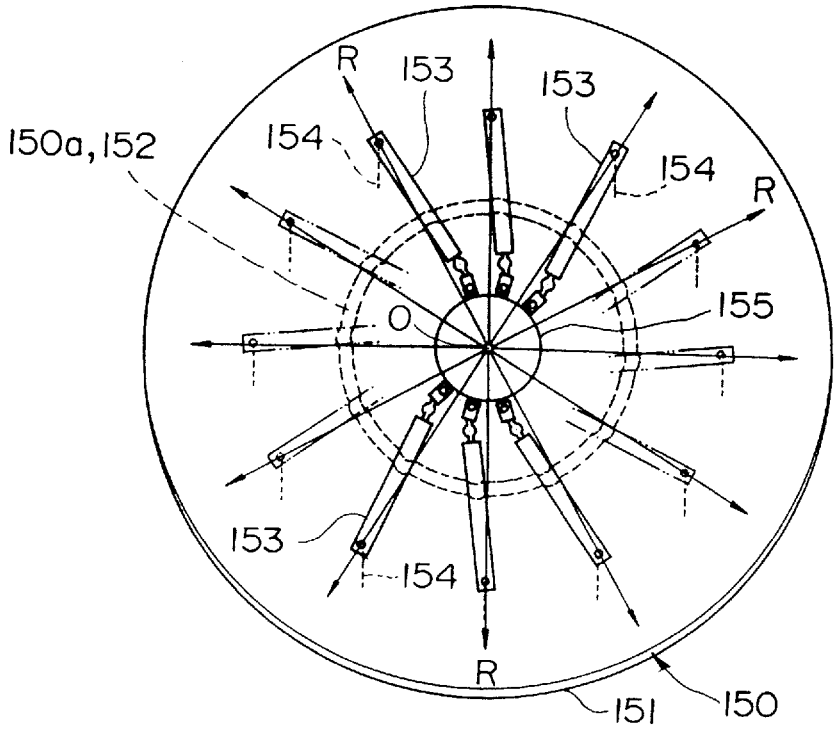

FIGS. 21A and 21B are back-face views showing the structure of the antenna having a strip line of the ninth embodiment, and in these FIGS. 21A and 21B, parts identical to those in FIG. 19 are given identical numbers, and explanations thereof are omitted here.

In FIGS. 21A and 21B, for example, positions of through holes (or slits) in projecting portion 150*a* and positions of strip conductors 153, 153, . . . are different from those shown in FIG. 19.

That is, in FIGS. 21A and 21B, slits or plural through holes are provided in each portion being off to an opposite orientation to direction R of the maximum microwave radiation with respect to radiators, similarly to the antenna using strip lines as shown in FIG. 17 or 18.

On the other hand, in FIG. 21A, terminals (existing near the other ends of strip conductors 153) of sector switch 155 (as shown in FIG. 19) and strip conductors 153, 153, . . . are formed as thin films, each in a slantwise direction by a predetermined angle with respect to the counterclockwise direction in the figure.

In contrast, in FIG. 21B, positions of terminals (existing near the other ends of strip conductors 153) of sector switch 155 (as shown in FIG. 19) are not changed, but only strip conductors 153, 153, . . . are formed as thin films, each in a slantwise direction by a predetermined angle with respect to the counterclockwise direction in the figure.

As explained above, according to the structure of the antenna using a strip line in the ninth embodiment of the present invention, through holes (or slits) are not provided in each portion (of projecting portion 150*a*) corresponding to an opposite orientation to direction R of the maximum microwave radiation with respect to radiators; thus, influences caused by the through holes (or slits) on antenna characteristics can be reduced in comparison with the antenna using a strip line of the seventh embodiment.

Tenth embodiment of antenna having distinctive strip line

Figure 22A:
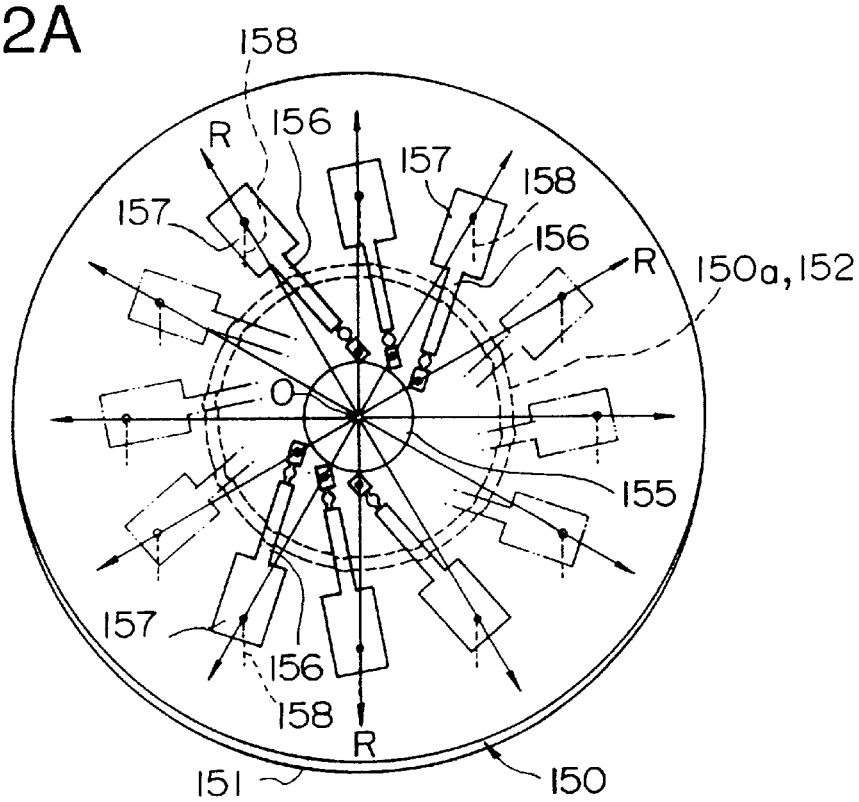
FIGS. 22A and 22B are back-face views showing the structure of an antenna having a distinctive strip line of the tenth embodiment
Figure 22B:
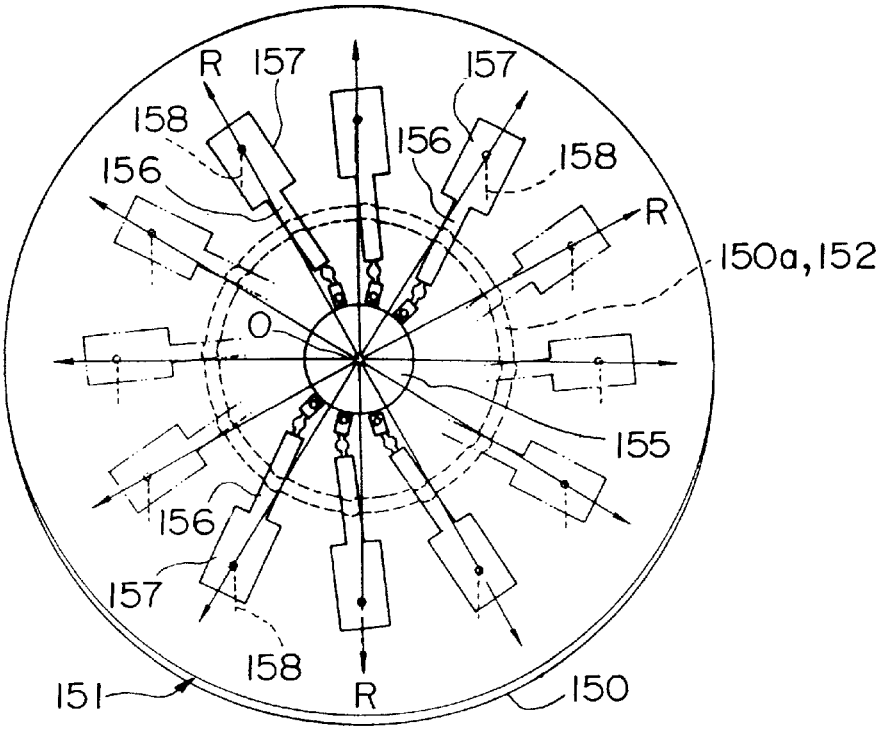

Hereinafter, a structure according to the tenth embodiment relating to an antenna having a distinctive strip line will be explained with reference to FIGS. 22A and 22B. FIGS. 22A and 22B are back-face views showing the structure of the antenna having a strip line of the tenth embodiment, and in these FIGS. 22A and 22B, parts identical to those in FIG. 20 are given identical numbers, and explanations thereof are omitted here.

In FIGS. 22A and 22B, for example, positions of through holes (or slits), strip lines 156, and quarter-wave wavelength matching circuits 157 are different in comparison with FIG. 20.

That is, in FIGS. 22A and 22B, slits or plural through holes are provided in each portion (of projecting portion 150*a*) being off to an opposite orientation to direction R of the maximum microwave radiation with respect to radiators, similarly to the antenna using strip lines as shown in FIG. 17 or 18.

On the other hand, in FIG. 22A, terminals (existing near the other ends of strip conductors 156) of sector switch 155 (as shown in FIG. 20), strip conductors 156, 156, . . . , and quarter-wave wavelength matching circuits 157, 157, . . . are formed as thin films, each in a slantwise direction by a predetermined angle with respect to the counterclockwise direction in the figure.

In contrast, in FIG. 22B, positions of terminals (existing near the other ends of strip conductors 156) of sector switch 155 (as shown in FIG. 20) are not changed, but only strip conductors 156, 156, . . . and quarter-wave wavelength matching circuits 157, 157, . . . are formed as thin films, each in a slantwise direction by a predetermined angle with respect to the counterclockwise direction in the figure.

As explained above, according to the structure of the antenna using a strip line in the tenth embodiment of the present invention, through holes (or slits) are not provided in each portion (of projecting portion 150*a*) corresponding to an opposite orientation to direction R of the maximum microwave radiation with respect to radiators; thus, influences caused by the through holes (or slits) on antenna characteristics can be reduced in comparison with the antenna using a strip line of the eighth embodiment.

Hereinafter, methods for manufacturing an antenna having a reflecting plate in which slits or through holes are provided will be explained.

If slits are provided in a reflecting plate as a constituent of the antenna, the direction of the slits correspond to those of parasitic element(s). Therefore, no concave or convex portion is observed in lines perpendicular to a ground plane; thus, it is sufficient to pull a mold toward a single direction. Accordingly, the number of molds necessary for manufacturing antennas is one, as in the above-described methods for easy manufacturing.

If through holes are provided in a reflecting plate, one of the following three manufacturing methods may be used.

(1) After an antenna is molded without a hole, as shown in FIG. 2A or the like, through holes are provided using a tool such as a cutting machine and the antenna is plated.

(2) After an antenna is molded without a hole, as shown in FIG. 2A or the like, through holes are provided using a second mold and the antenna is plated.

(3) The first portion (refer to reference numeral 170 in FIG. 26B) consisting of fins and a reflecting plate having through holes and the second portion (refer to reference numeral 171 in FIG. 26B) consisting of a ground plane and parasitic elements are respectively formed using two molds and then combined, and the combined portions are plated.

Figure 26A:
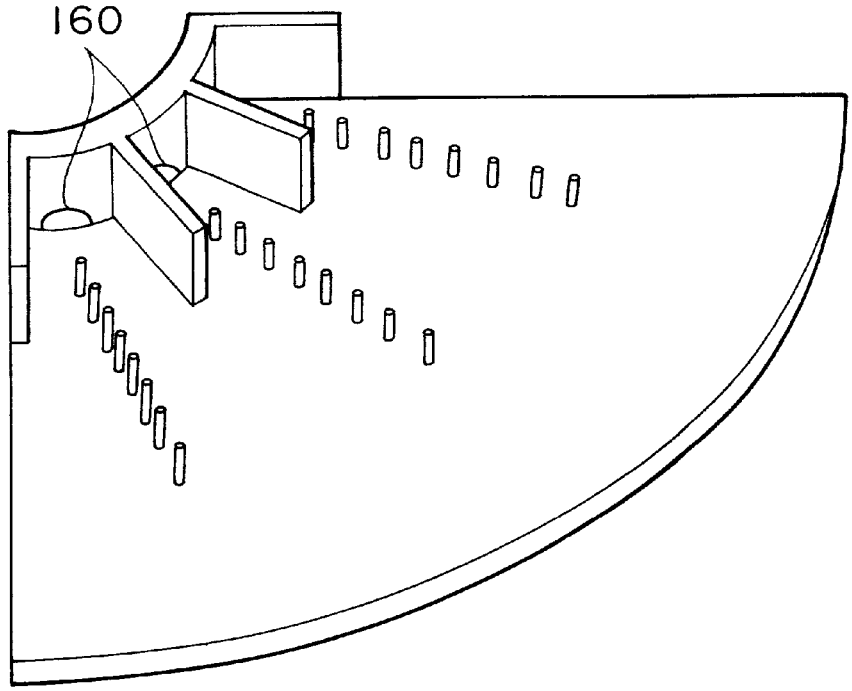
FIGS. 26A and 26B are for explaining an example of a method for manufacturing an antenna whose reflector has through holes.
Figure 26B:
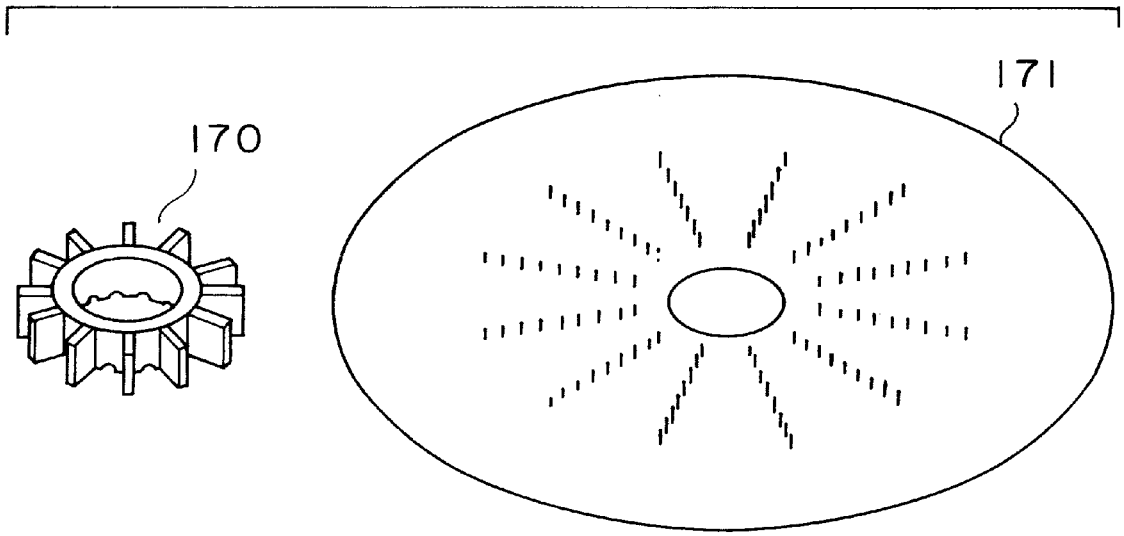

If the above method (2) is adopted for manufacturing multi-sector circular antennas having through holes, a divided portion (as a quarter or the like, as shown in FIG. 26A) may be manufactured using a first mold for easy drawing, and through holes 160 are then formed using a second mold. After these processes, the two portions are combined so as to make a circular form. In this way, molds can be easily drawn.

In addition, if two portions are combined in the above manufacturing method (3), the combination (as integral) is performed by (i) using solder, (ii) using conductive adhesive, or (iii) previously forming a portion into which the remaining portion is put, and fitting the remaining portion into this previously-formed portion.

After the above manufacturing processes, strip lines and the like are formed so as to complete an antenna.

Here, the shape of the ground plane of the antenna may be a rectangle (as shown in FIG. 14A or 16A), a circle (as shown in FIG. 19, etc.), or a fan (as shown in FIG. 5A, etc.)

As explained above, by providing through hole(s) in a projecting portion, the thickness of the dielectric material can be assumed to be fixed over all areas with respect to strip conductors; thus, in addition to easy manufacturing, the characteristic impedance can be fixed over all areas. Therefore, even though a very thick projecting portion exists in the dielectric material, reflection and loss of electromagnetic waves as transmission media can be reduced.

In addition, by providing plural slits in a projecting portion, the thickness of the dielectric material can be assumed to be fixed over all areas with respect to strip conductors; thus, the characteristic impedance can be fixed over all areas. Therefore, even though a very thick projecting portion exists in the dielectric material, reflection and loss of electromagnetic waves as transmission media can also be reduced, in this case.

Furthermore, by providing through hole(s) or slits in a reflecting plate, the thickness of the dielectric material can be electrically assumed to be fixed. Therefore, the ground plane functions as the common ground for the antenna elements and the strip conductors. In addition, the antennas can be easily manufactured using fewer molds for metal cast mold casting in comparison with the antenna having a triplate structure.

On the other hand, by providing through hole(s) or slits in each position which does not overlap with an opposite orientation to the direction of the maximum radiation of an electric wave radiated from each antenna element, influences caused by through holes or slits on the antenna characteristics can be reduced.

Antenna consisting of plural antenna units having different operational frequencies Recently, high-speed wireless LANs have attracted attention, and various frequencies such as 19 GHz, 2.4 GHz, 5 GHz, and 60 GHz are examined, as shown in list 1.

Therefore, if a narrow-beam multi-sector antenna relating to any plural frequencies such as "5 GHz and 19 GHz" or "19 GHz and 60 GHz" can be realized as a single antenna, convenience for terminal users can be improved and constructions for establishing base stations can be reduced.

Accordingly, regarding antennas having the above-mentioned structure for easy manufacturing, embodiments in which antenna units having different operational frequencies are included in the antenna will be explained hereinbelow.

Figure 27A:
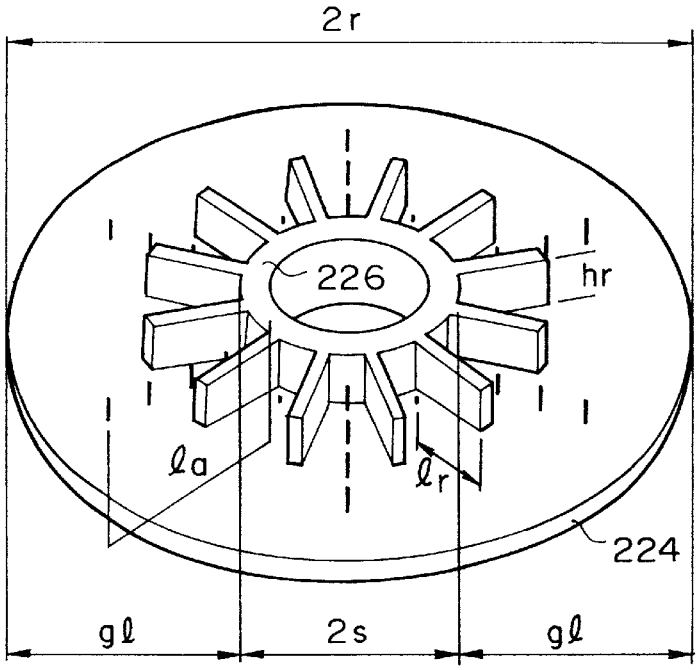
FIGS. 27A and 27B show the first embodiment of an antenna consisting of antenna units having different operational frequencies.
Figure 27B:
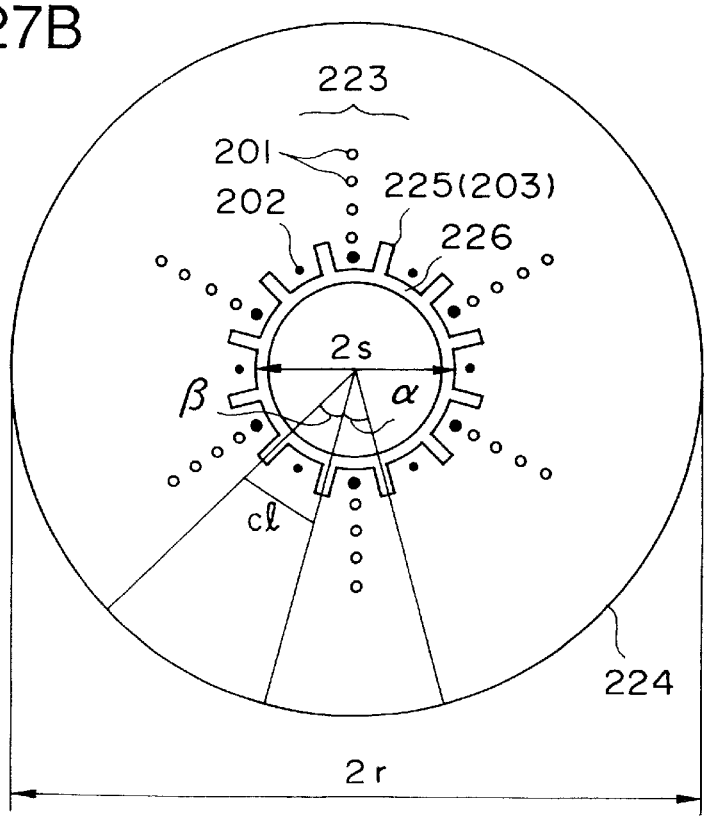

FIGS. 27A and 27B show the first embodiment of an antenna consisting of antenna units having different operational frequencies, that is, an example of an antenna using common frequencies. FIG. 27A is a perspective view, while FIG. 2713 shows an upper face.

This antenna operates at both first lower frequency f1 and second higher frequency f2, and this sing [illegible] antenna consists of a 6-sector antenna for frequency f1 and another 6-sector antenna for frequency f2.

In FIGS. 27A and 27B, reference numerals 201 indicate elements which operate at the first frequency f1, and in this embodiment, these correspond to a monopole Yagi-Uda antenna indicated by reference numeral 223. Reference numeral 225 indicates fin(s) in this monopole Yagi-Uda antenna, and the fin(s) simultaneously function as reflector(s) 203 of a corner reflector antenna as the second sector antenna which operates at frequency f2.

Reference numeral 202 indicates radiating element(s) of the second sector antenna, reference numeral 224 indicates a ground plane, and reference numeral 226 indicates a cylindrical reflector. On the other hand, reference symbol "2r" indicates the diameter of ground plane 224, reference symbol "2s" indicates the diameter of cylindrical reflector 226, reference symbol "gl" indicates the ground plane length (which means a distance from cylindrical reflector 226 to an end of the ground plane), reference symbol "la" indicates an array length, reference symbol "lr " indicates the fin length, and reference symbol "hr" indicates the fin height. These definitions are also used with respect to other drawings later explained.

Here, the "corner reflector antenna" means an antenna having radiator 202 and two fins 203 adjacent to this radiator 202.

In the monopole Yagi-Uda antenna, the horizontal beam width is adjusted according to array length la while the vertical beam width is adjusted according to ground plane length gl.

In the corner reflector antenna, if the length of fin 203 corresponds to the wavelength specified according to the used radio frequency, the beam width can be adjusted according to corner angle β. However, if the length of fin 203 is smaller than the wavelength, such adjustment is performed using the length and height of fin 203 in addition to the corner angle. Also in the corner reflector antenna, arc length "cl" which influences an aperture area according to the operational frequency is changed.

For example, with the first low frequency f1 of 5 GHz and the second high frequency f2 of 19.5 GHz, if fin length lr is 0.5 times as long as the wavelength at frequency f1, then at frequency f2, the length becomes 1.95 times as long as the wavelength. Here, an example in which fin length lr is 0.5 times as long as the wavelength at frequency f1 is shown; however, it is necessary to determine the fin length and the like in consideration of the frequencies adopted for each antenna.

Figure 28A:
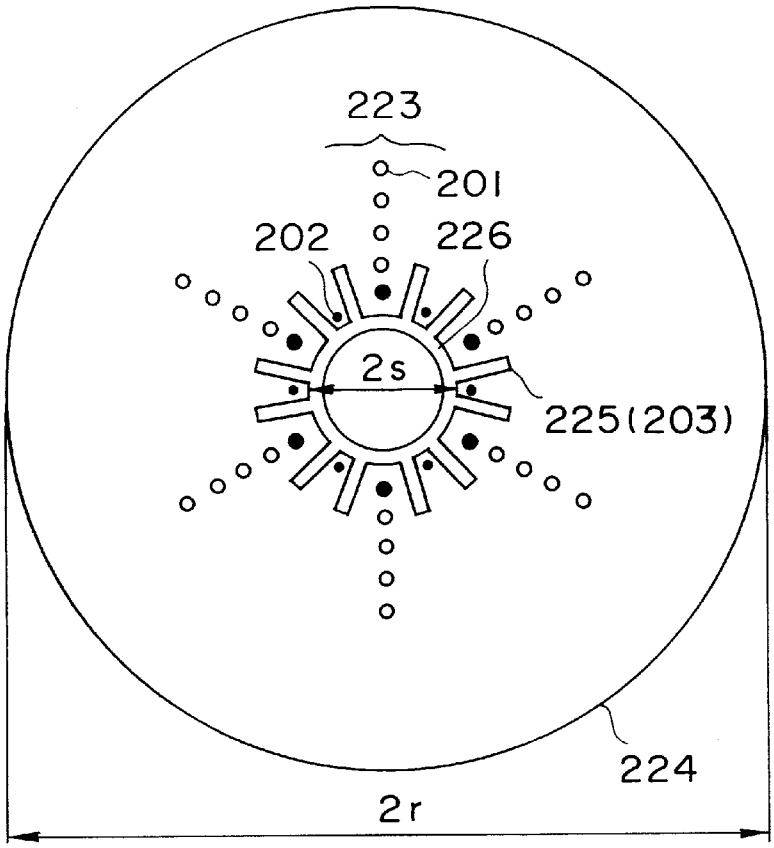
FIGS. 28A and 28B show the second embodiment of an antenna consisting of antenna units having different operational frequencies.
Figure 28B:
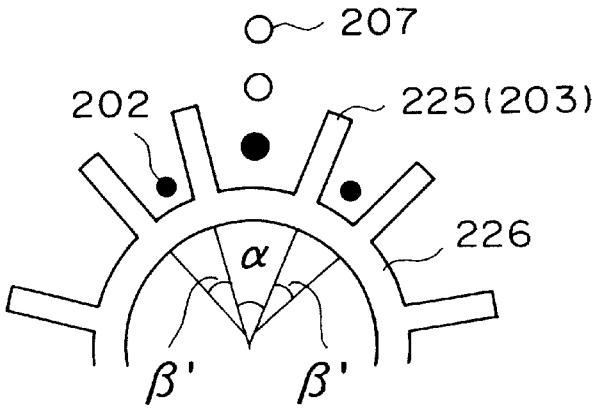

FIGS. 28A and 28B show the second embodiment of an antenna consisting of antenna units having different operational frequencies, and this is an example of an antenna using two kinds of common frequencies. FIG. 28A shows an example in which the monopole Yagi-Uda antenna as shown in FIGS. 27A and 27B is used for elements of a sector antenna which operates at a first frequency, and diameter 2s of the cylindrical reflector is different from that in the case shown in FIGS. 27A and 27B. In this way, arc length cl which influences the aperture area of the second sector antenna can be changed according to the frequency.

That is, as shown in FIG. 28B, it is possible to change the corner angle of an antenna (element) which consists the corner reflector antenna from β (refer to FIG. 27B) to β' by changing diameter 2s of the cylindrical reflector, while corner angle of an antenna (element) as a constituent of the monopole Yagi-Uda antenna is fixed.

Additionally, in FIGS. 28A and 28B, parts identical to those in FIGS. 27A and 27B are given identical numbers, and explanations thereof are omitted. Also in the following drawings, parts corresponding to those already explained will be given identical numbers, and explanations thereof will be omitted.

Figure 29A:
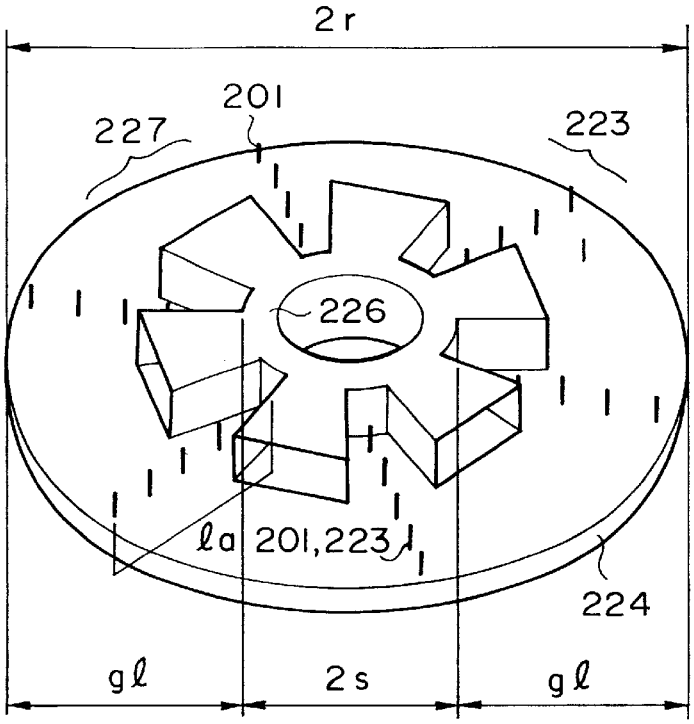
FIGS. 29A and 29B show the third embodiment of an antenna consisting of antenna units having different operational frequencies.
Figure 29B:
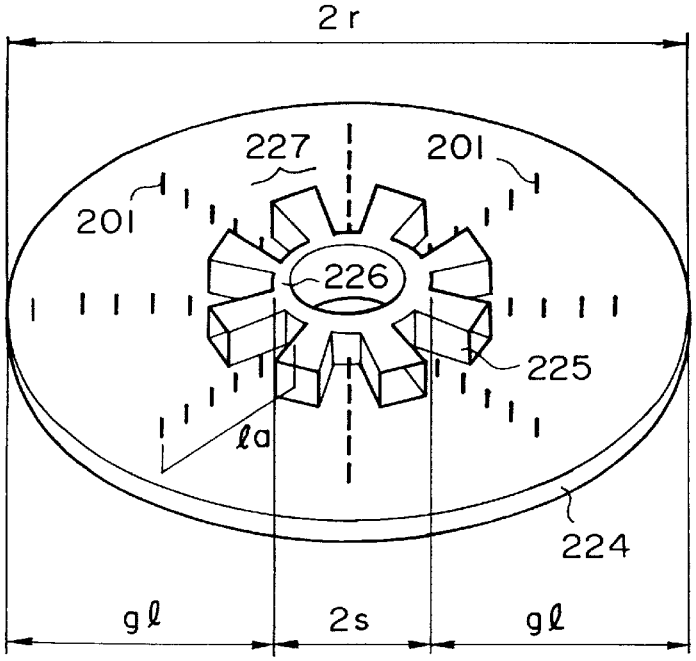

FIGS. 29A and 29B show the third embodiment of an antenna consisting of antenna units having different operational frequencies, and this is also an example of an antenna using two kinds of common frequencies. FIGS. 29A and 29B show an example in which an antenna having the second operational frequency is horn antenna 227. FIG. 29A shows an example in which antennas operating at two frequencies are both 6-sector type, while FIG. 29B shows that these antennas are both 8-sector type. In each case, the side face of the horn antenna also acts as the side face of the monopole Yagi-Uda antenna.

Here, the "horn antenna" means an antenna comprising a radiator, two fins adjacent to the radiator, and a metal cap covering the two fins. In addition, the beam width of the horn antenna can be adjusted according to an area of aperture of the horn antenna. Also, by changing the longitudinal and transverse lengths at the aperture, different radiation patterns can be obtained. Accordingly, in consideration of these points, specification values for the horn antenna are determined.

Figure 30:
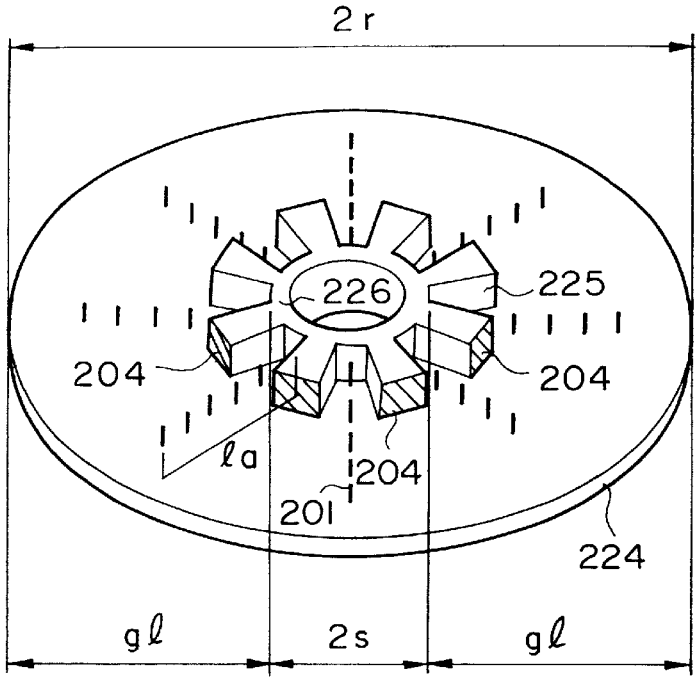
FIG. 30 shows the fourth embodiment of an antenna consisting of antenna units having different operational frequencies.

FIG. 30 shows the fourth embodiment of an antenna consisting of antenna units having different operational frequencies, and this is also an example of an antenna using two kinds of common frequencies. The antenna in FIG. 30 has the same structure as that shown in FIGS. 19A and 19B, and here, dielectric material 204 is provided in horn antenna 227 which operates at the second frequency. According to the present invention, although the sizes of each fin or cylinder diameter 2s are fixedly determined, a desirable beam width can be realized at a desirable frequency, by adjusting the thickness or the relative dielectric constant of dielectric material 204.

In addition, also in the corner reflector antenna, a desirable beam width can be realized at a desirable frequency by providing a dielectric material and adjusting the thickness or the relative dielectric constant of the dielectric material.

Figure 31:
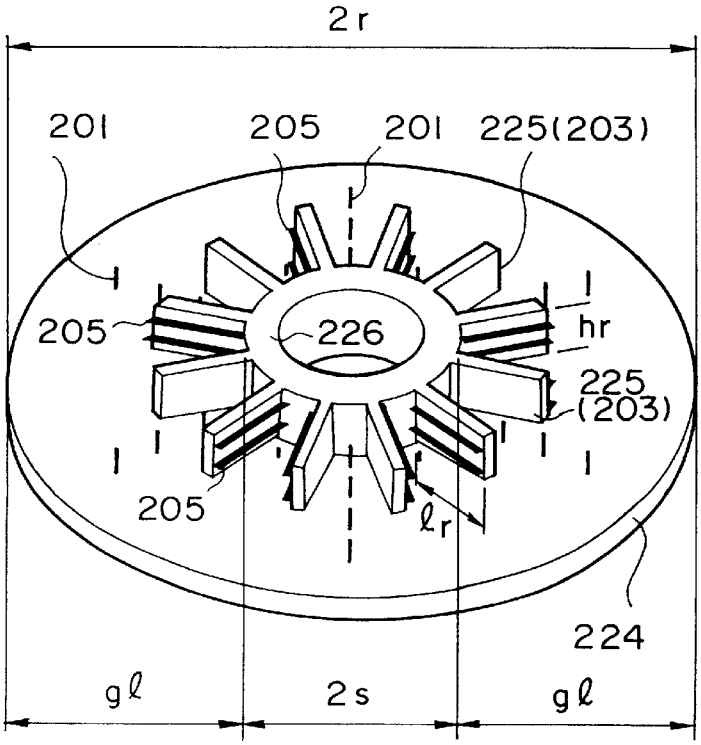
FIG. 31 shows the fifth embodiment of an antenna consisting of antenna units having different operational frequencies.

FIG. 31 shows the fifth embodiment of an antenna consisting of antenna units having different operational frequencies, and this is also an example of an antenna using two kinds of common frequencies. FIG. 31 shows an example in which a sector antenna which operates at the second frequency is a corner-reflector type, and a control for obtaining a desirable beam width at a desirable frequency is realized by providing metallic fin(s) indicated by reference numeral 205.

Here, adjustment of the beam width is performed by preparing metallic fins having the most suitable length with respect to a circumferential direction of the antenna, and adjusting the number of the fins and the length of each metallic fin in a direction with respect to radiators (i.e., the width of each fin).

Here, in the horn antenna, the beam width can also be adjusted in a similar way using metallic fins.

Figure 32:
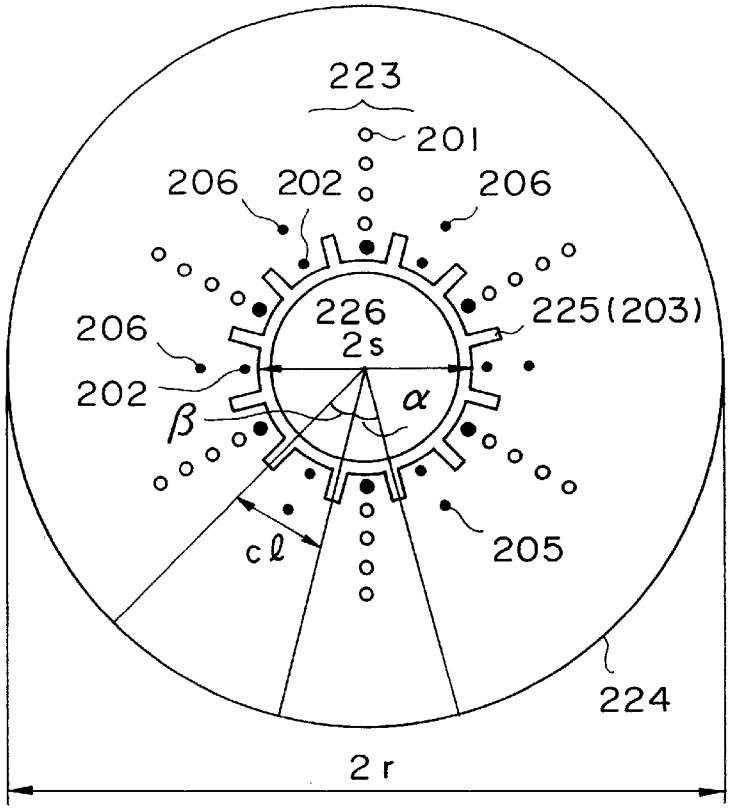
FIG. 32 shows the sixth embodiment of an antenna consisting of antenna units having different operational frequencies.

FIG. 32 shows the sixth embodiment of an antenna consisting of antenna units having different operational frequencies, also an example of an antenna using two kinds of common frequencies. FIG. 32 shows an example in which a sector antenna which operates at the second frequency is a corner-reflector type, and the second sector antenna also has parasitic elements 206. According to the above structure, a control for obtaining a desirable beam width at a desirable frequency is performed.

Here, the beam width is adjusted as follows. The heights of parasitic elements 206 and radiators 202 is set to be about ¼ times as much as the wavelength with respect to a desired frequency. As the diameter of each element becomes larger, the corresponding height is set to be a little smaller than the "¼ wavelength" so as to make the element resonant at the desired frequency. In addition, the height of parasitic element 206 is set to be smaller than that of radiator 202 so that an electric wave can be transmitted from radiator 202 to parasitic element 206. As described above, the length of each element relates to its operational frequency.

Regarding the beam width of radiation pattern in horizontal and conical planes become narrower by providing parasitic elements. In this case, the level of sharpness is changed according to the number of parasitic elements, that is, the greater the number of parasitic elements, the narrower the beam width become.

In the horn antenna, it is also possible to set the length of each radiator to be ¼ times as long as the wavelength with respect to an operational frequency, and to perform adjustment for realizing a beam width suitable for the desired frequency by providing radiators or parasitic elements.

Figure 33:
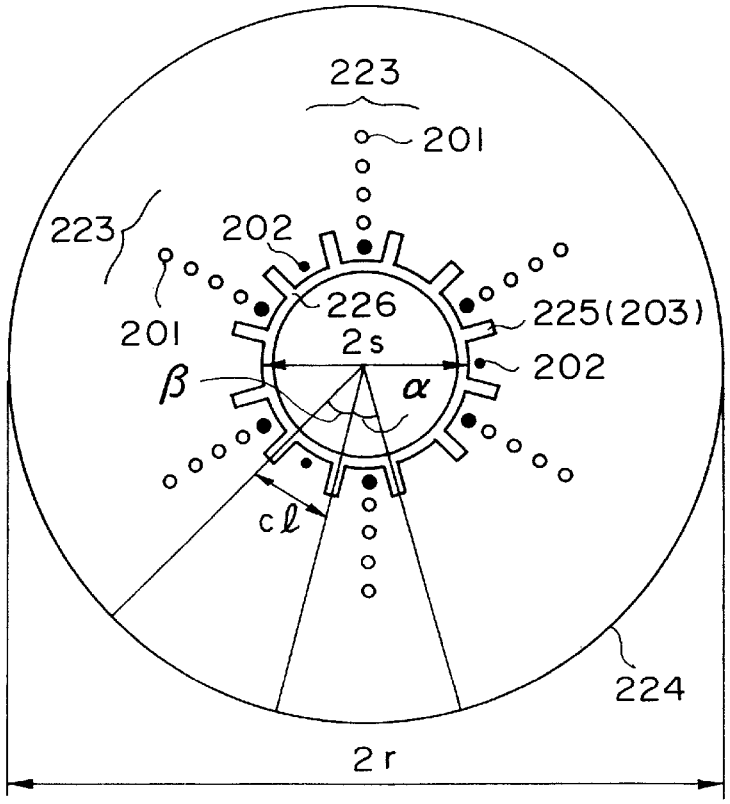
FIG. 33 shows the seventh embodiment of an antenna consisting of antenna units having different operational frequencies.

FIG. 33 shows the seventh embodiment of an antenna consisting of antenna units having different operational frequencies, also an example of an antenna using two kinds of common frequencies. FIG. 33 shows an example in which the first sector antenna operating at the first frequency has 6 sectors while the second sector antenna operating at the second frequency has 3 sectors. In this case, it is preferable that the half power in the horizontal plane of the first sector antenna be 60° (i.e., 360°/6 sectors) while the half power in the horizontal plane of the second sector antenna should preferably be 120° (i.e., 360°/3 sectors), so as to cover the circumferential direction (i.e., 360°) at each frequency.

Figure 34:
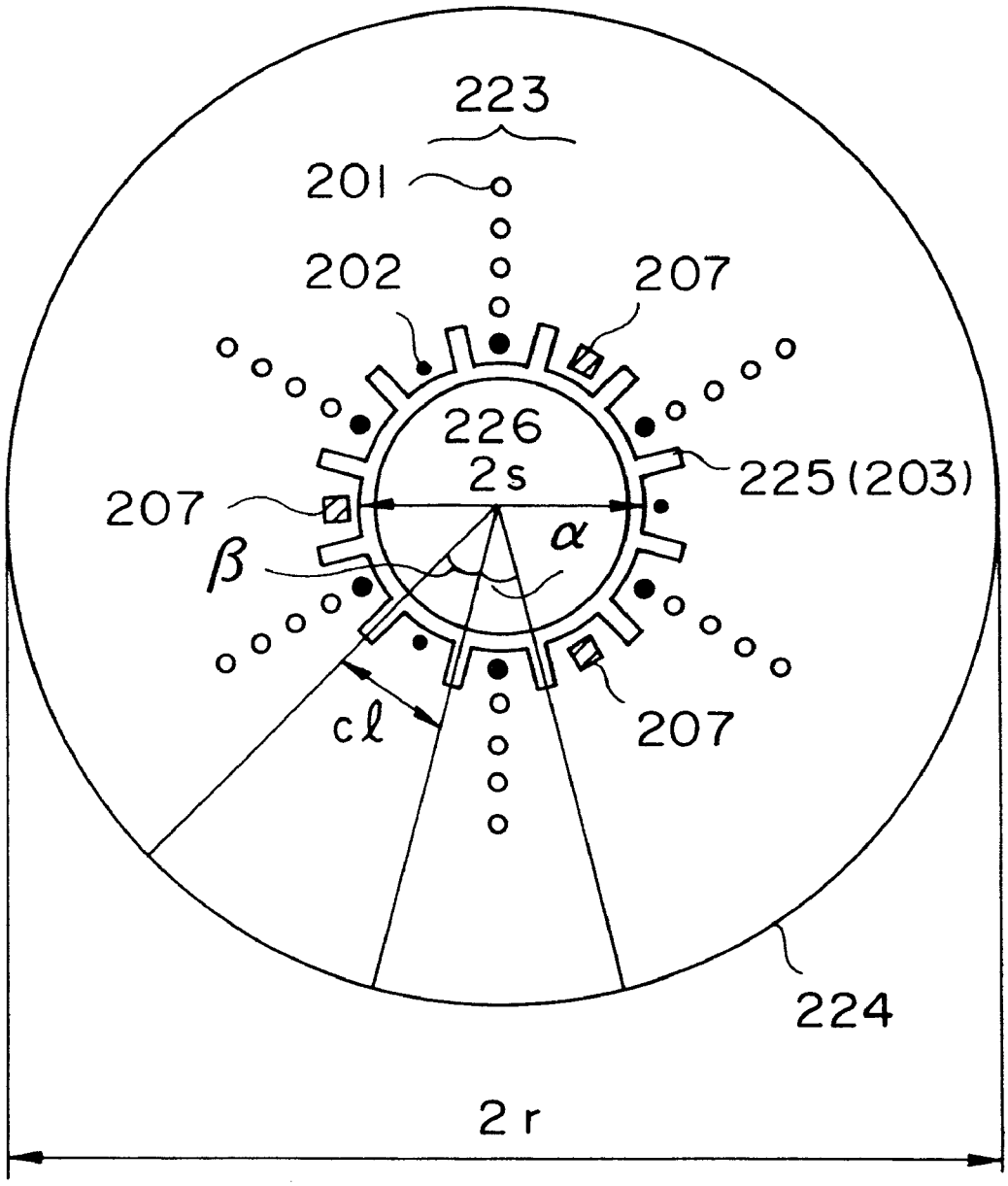
FIG. 34 shows the eighth embodiment of an antenna consisting of antenna units having different operational frequencies.

FIG. 34 shows the eighth embodiment of an antenna consisting of antenna units having different operational frequencies, and this is an example of an antenna using three kinds of common frequencies. FIG. 34 shows an example in which the first 6-sector antenna (unit) operating at the first frequency, the second 3-sector antenna (unit) operating at the second frequency, and the third 3-sector antenna (unit as shown by reference numeral 207) operating at the third frequency are realized as a single antenna. According to the present invention, the number of common frequencies are not limited to "two" but an arbitrary number may be adopted, as shown in FIG. 34.

Regarding FIG. 34, in order to obtain the half power of 120° by using reflectors whose physical sizes are the same and whose electrical sizes are different with respect to the sector antennas of the second and third frequencies, a control as shown in the above-mentioned embodiments may be performed at one of the frequencies, that is, at least one of (i) dielectric material, (ii) metallic fins, and (iii) parasitic elements may be provided, or a distance between each radiator and reflector may be adjusted. According to the present invention, a common-frequency antenna having any number of sectors and using any numbers of operational frequencies can be realized.

Figure 35A:
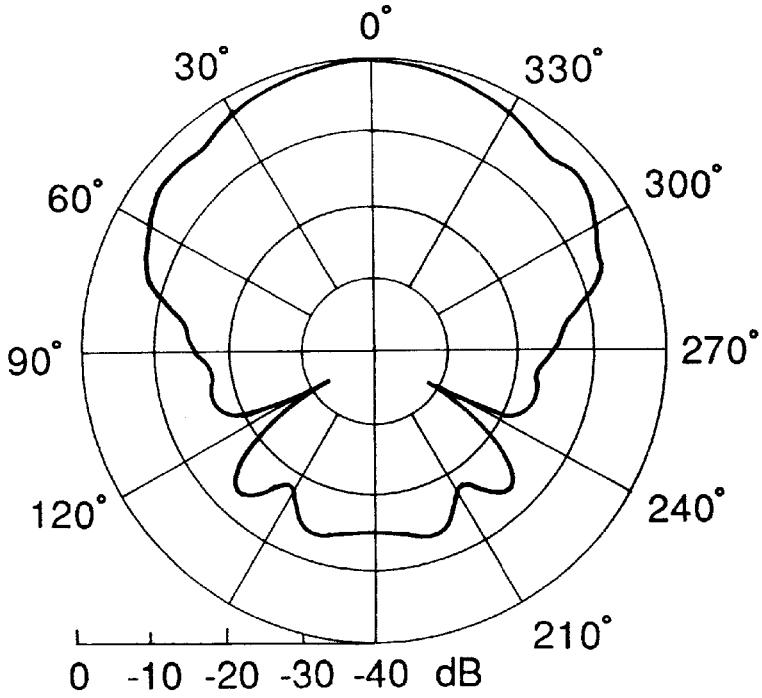
FIGS. 35A and 35B show examples of the radiation pattern in a horizontal plane with respect to an antenna consisting of plural antenna units of different operational frequencies.
Figure 35B:
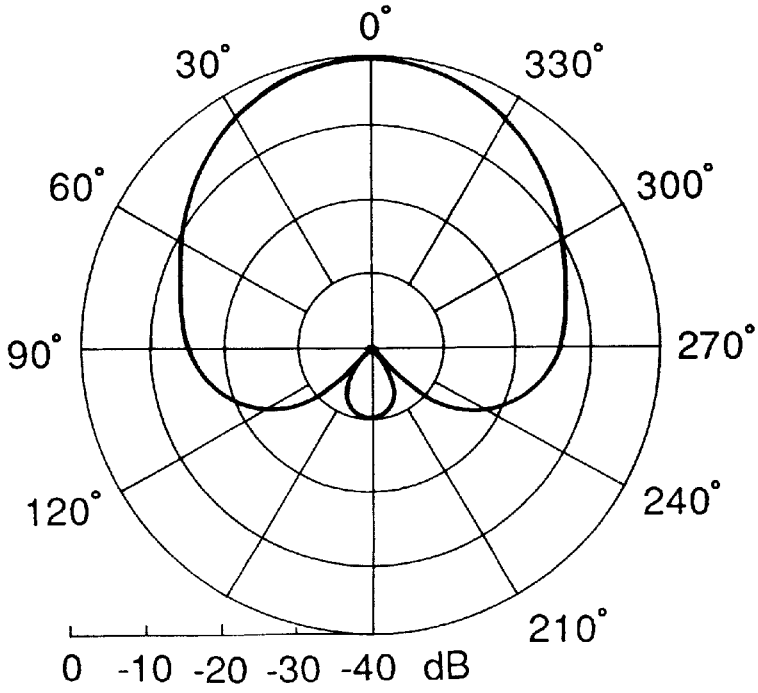

Next, regarding the above explained antenna shown in FIGS. 27A and 27B, calculation results using the moment method with parameters shown in the following "list 1" are shown in FIGS. 35A and 35B.

FIG. 35A shows the radiation pattern in a horizontal plane with respect to the lower frequency f1, while FIG. 35B shows the radiation pattern in a horizontal plane with respect to the higher frequency f2.

LIST 1

| SYMBOL | DEFINITION | PARAMETER |
|---|---|---|
| f1 | lower frequency | f1:f2 = 1:2 |
| f2 | higher frequency | |
| $\lambda_{f1}$ | wavelength of frequency f1 | |
| $\lambda_{f2}$ | wavelength of frequency f2 | |
| 2r | diameter of ground plane | 3.9 $\lambda_{f1}$ |
| 2s | diameter of cylinder | 1.1 $\lambda_{f1}$ |
| gl | ground plane length | 2.8 $\lambda_{f1}$ |
| la | array length | 1.0 $\lambda_{f1}$ |
| hr | height of reflector | 0.39 $\lambda_{f1}$ |
| lr | fin length | 0.52 $\lambda_{f1}$ |

In this example, the ratio of lower frequency f1 to higher frequency f2 is set to be "1 to 2". The present antenna operates at the lower frequency f1 as a monopole Yagi array antenna, and also operates at the higher frequency f2 as a corner reflector antenna using fins as corner reflectors. As shown in FIGS. 35A and 35B, sector beams having a beam width of 60° at −3 dB can be obtained at each frequency.

Here, a method for manufacturing a multicommon-frequency sector antenna using different operational frequencies will be explained. In such an antenna, the portions as the ground plane, parasitic elements, reflecting plate, and fins are molded using a single mold and are then plated, as in the case of the above-descrived antenna for easy manufacturing. If a sector is provided as a horn antenna, a cap, made of a metallic plate, which covers two adjacent fins, is provided. Additionally, according to necessity, metallic fins or a dielectric material may be provided in manufacturing.

As the multi-common-frequency sector antenna consisting of plural antenna units of different operational frequencies has the above-explained structure, for example, a 2 common-frequency antenna can be realized by using fins included in a multi-sector monopole Yagi-Uda antenna of the first operational frequency as reflectors of a corner reflector antenna of the second operational frequency.

Another 2 common-frequency antenna can be realized by using fins included in a thin sector antenna of the first operational frequency as a part of a horn antenna of the second operational frequency.

Here, fins of the multi-sector monopole Yagi-Uda antenna are provided for controlling undesired radiation from a next array. However, in order not to damage original characteristics possessed of the Yagi-Uda antenna, the length of fins is preferably about 0.5 times as long as the wavelength, that is, a length suitable for covering a radiator.

In contrast, regarding the corner reflector, the longer the corner length, the narrower the directionality becomes. In the present invention, by using the antenna of the higher operational frequency as the second sector antenna, the fins, whose electrical lengths are short enough for operations at the lower frequency, can also be used as reflectors whose electrical lengths are long enough for operations at the higher frequency.

Furthermore, according to the multi-common-frequency sector antenna consisting of plural antenna units of different operational frequencies, even if the length of fins is limited according to the first frequency, desirable characteristics (such as a beam width) can be assigned for the second multi-sector antenna by providing the second multi-sector antenna with the dielectric material, metallic fins, and parasitic elements.

On the other hand, the function of each monopole element corresponds to that of a parasitic element at the first frequency, but is omitted at the second frequency. This is because if the second frequency is low (i.e., the wavelength is high), the monopole element is small enough to be omitted with respect to the wavelength, while if the second frequency is high (i.e., the wavelength is low), a corresponding space between the monopole elements is electrically very large and these elements do not act on each other. Therefore, by using such monopole elements as parasitic elements, reflecting plates of a fixed size can be used for two or more kinds of common frequencies, or for any frequency ratio.

In addition, the above-described techniques with respect to strip lines may be added to the present antenna consisting of plural antenna units of different operational frequencies.

As explained above, according to the antenna consisting of plural antenna units of different operational frequencies, a sector antenna for commonly using plural frequencies can easily be realized without changing the size of a conventional thin sector antenna. Consequently, by establishing the present type of antenna, it is possible to reduce base stations, and to improve reduction in size of terminals of a wireless LAN on which plural kinds of services can be provided and used.

As explained above, according to the antenna having a structure in which projecting portions are provided toward a single direction, small and thin antenna satisfying desirable antenna capabilities can be easily manufactured.

When distinctive strip line(s) are further used for the basic antenna (having the above structure for easy manufacturing), it is possible to reduce reflection and loss of electromagnetic waves as transmission media, in addition to easy manufacturing.

When such an antenna having the above two features is further modified to include plural antenna units of different operational frequencies, an antenna which can be easily manufactured and which functions at plural frequencies can be realized.

What is claimed is:

1. An antenna having a basic structure comprising:

a cylindrical member, provided on one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, wherein the basic structure is formed with a dielectric material using one or more metal molds;

the surface of one face of the first board-shaped dielectric material and the surfaces of the cylindrical member, the second board-shaped members and the pole members are coated with a conductive coating, by which the first board-shaped dielectric material, the cylindrical member, the second board-shaped members, and the pole members function as a ground plane, a reflector, fins, and parasitic elements, respectively; and a radiator is provided on an extension from each line on which a set of the parasitic elements on the ground plane exists and between the innermost parasitic element and the outer surface of the reflector, each radiator being formed by forcing out a corresponding portion of the dielectric material as the ground plane, and by making a hole in the forced-out portion and providing a conductive material into the hole.

2. An antenna comprising:

a first board-shaped dielectric material;

a cylindrical member provided on one face of the first board-shaped dielectric material;

plural second board-shaped members provided as radiating on the outer surface of the cylindrical member, one end face of each second board-shaped member being in contact with the surface of the first board-shaped dielectric material; and third board-shaped members perpendicular to the surface of the first board-shaped dielectric material, made by forcing out corresponding portions of the first board-shaped dielectric material, the third board-shaped members radiating from the outer surface of the cylindrical member, and each third board-shaped member existing between two positional directions of the adjacent two second board-shaped members;

wherein the surface as one face of the first board-shaped dielectric material and the surfaces of each above member are coated with a conductive coating, by which the first board-shaped dielectric material, the cylindrical member, and the second board-shaped members function as a ground plane, a reflector, and fins, and plural strip-shaped conductive coats are arranged as parasitic elements on one face of each third board-shaped member; and radiators are provided, each radiator being disposed between the set of plural parasitic elements arranged on one face of each third board-shaped member and the outer surface of the reflector.

3. An antenna as claimed in claim 2, wherein the radiators are provided on the one face of the first board-shaped dielectric material, each radiator being on an extension line from each third board-shaped member and between one end of the relevant third board-shaped member and the outer surface of the reflector.

4. An antenna as claimed in claim 2, wherein each radiator is arranged as a strip-shaped conductive coat on the one face of the relevant third board-shaped member, together with the plural parasitic elements.

5. An antenna having a basic structure comprising:

a cylindrical member, provided on one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, wherein the basic structure is formed with a dielectric material using one or more metal molds;

the surface of one face of the first board-shaped dielectric material and the surfaces of the cylindrical member, the second board-shaped members and the pole members are coated with a conductive coating, by which the first board-shaped dielectric material, the cylindrical member, the second board-shaped members, and the pole members function as a ground plane, a reflector, fins, and parasitic elements, respectively; and a radiator is provided on an extension from each line on which a set of the parasitic elements on the ground plane exists and between the innermost parasitic element and the outer surface of the reflector, at least a part of each of the radiators and parasitic elements being buried by a hardening material having a relative dielectric constant of almost 1.

6. An antenna having a basic structure comprising:

a cylindrical member, provided on one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, wherein the basic structure is formed with a dielectric material using one or more metal molds;

the surface of one face of the first board-shaped dielectric material and the surfaces of the cylindrical member, the second board-shaped members and the pole members are coated with a conductive coating, by which the first board-shaped dielectric material, the cylindrical member, the second board-shaped members, and the pole members function as a ground plane, a reflector, fins, and parasitic elements, respectively; and a radiator is provided on an extension from each line on which a set of the parasitic elements on the ground plane exists and between the innermost parasitic element and the outer surface of the reflector, wherein plural through holes having a first width in a transverse direction are provided at plural positions with equal spaces in a circumferential line at the base of the reflector, each through hole being formed such that the lower face and the surface of the ground plane are coplanar and said lower face is coated with a conductive coating; and plural strip lines are respectively provided on the back face of the ground plane below each through hole, the width of each strip line being smaller than the first width, and feeding is performed by connecting each strip line to the corresponding radiator.

7. An antenna as claimed in claim 6, wherein a quarter-wave wavelength matching circuit is inserted between each strip line and the corresponding radiator.

8. An antenna as claimed in claim 6, wherein each through hole is disposed at a position being off to an opposite orientation to a direction of the maximum radiation of an electric wave radiated from each radiator.

9. An antenna having a basic structure comprising:

a cylindrical member, provided on one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, wherein the basic structure is formed with a dielectric material using one or more metal molds;

the surface of one face of the first board-shaped dielectric material and the surfaces of the cylindrical member, the second board-shaped members and the pole members are coated with a conductive coating, by which the first board-shaped dielectric material, the cylindrical member, the second board-shaped members, and the pole members function as a ground plane, a reflector, fins, and parasitic elements, respectively; and a radiator is provided on an extension from each line on which a set of the parasitic elements on the ground plane exists and between the innermost parasitic element and the outer surface of the reflector, wherein plural slits are provided at plural positions with equal spaces in a circumferential line at the base of the reflector; and plural strip lines are formed on the back face of the ground plane below the reflector, and feeding is performed by connecting one of the strip lines to each radiator.

10. An antenna as claimed in claim 9, wherein a quarter-wave wavelength matching circuit is inserted between each strip line and the corresponding radiator.

11. An antenna as claimed in claim 9, wherein each slit is disposed only at a position being off to an opposite orientation to a direction of the maximum radiation of an electric wave radiated from each radiator.

12. An antenna having a basic structure comprising:

a cylindrical member, provided on one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, wherein the basic structure is formed with a dielectric material using one or more metal molds;

the surface of one face of the first board-shaped dielectric material and the surfaces of the cylindrical member, the second board-shaped members and the pole members are coated with a conductive coating, by which the first board-shaped dielectric material, the cylindrical member, the second board-shaped members, and the pole members function as a ground plane, a reflector, fins, and parasitic elements, respectively;

a radiator is provided on an extension from each line on which a set of the parasitic elements on the ground plane exists and between the innermost parasitic element and the outer surface of the reflector;

an antenna switch is provided for switching plural antennas, each antenna being mounted in an area surrounded by the adjacent two fins and a part of the reflector;

plural sets of antenna units are mounted on the same ground plane, each set having a different operational frequency and the antennas belonging to each set operating at the same operational frequency; and each antenna and the next antenna commonly possess and use one of the fins.

13. An antenna as claimed in claim 12, wherein one antenna belonging to at least one of the plural sets of antennas consists of a radiator.

14. An antenna as claimed in claim 12, wherein one antenna belonging to at least one of the plural sets of antennas consists of a series of monopole elements which are composed of a radiator and plural parasitic elements.

15. An antenna as claimed in claim 12, wherein one antenna belonging to at least one of the plural sets of antennas is a corner reflector antenna consisting of a radiator and two of the fins, which are adjacent to the radiator.

16. An antenna as claimed in claim 15, wherein the corner reflector antenna comprises a dielectric material.

17. An antenna as claimed in claim 15, wherein the corner reflector antenna comprises a metallic fin.

18. An antenna as claimed in claim 15, wherein the corner reflector antenna comprises a parasitic element.

19. An antenna as claimed in claim 12, wherein one antenna belonging to at least one of the plural sets of antennas is a horn antenna consisting of a radiator, two of the fins, which are adjacent to the radiator, and a metal cap covering the two fins.

20. An antenna as claimed in claim 19, wherein the horn antenna comprises a dielectric material.

21. An antenna as claimed in claim 19, wherein the horn antenna comprises a metallic fin.

22. An antenna as claimed in claim 19, wherein the horn antenna comprises a parasitic element.

23. A method of manufacturing an antenna having a basic structure comprising:

a first board-shaped dielectric material;

a cylindrical member, one end face of which being in contact with one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, the method comprising the steps of:

forming the basic structure with a dielectric material using one of the injection and compression molding methods;

coating the surface as one face of the first board-shaped dielectric material and the surfaces of each above member with a conductive coating by metal coating; and providing a radiator on an extension of the line on which the plural pole members in each set are arranged, on the relevant face of the first board-shaped dielectric material, and between the innermost member of said plural pole members in a line and the outer surface of the cylindrical member, each radiator being formed by forcing out a corresponding portion of the relevant face of the first board-shaped dielectric material and making a hole in the forced-out portion, and by providing a conductive material into the hole.

24. A method of manufacturing an antenna having a basic structure comprising:

a first board-shaped dielectric material;

a cylindrical member, one end face of which being in contact with one face of the first board-shaped dielectric material;

plural second board-shaped members provided as radiating on the outer surface of the cylindrical member, one end face of each second board-shaped member being in contact with the surface of the first board-shaped dielectric material; and third board-shaped members perpendicular to the surface of the first board-shaped dielectric material, made by forcing out corresponding portions of the first board-shaped dielectric material, the third board-shaped members radiating from the outer surface of the cylindrical member, and each third board-shaped member existing between two positional directions of the adjacent two second board-shaped members;

the method comprising the steps of:

forming the basic structure using a dielectric material by using one of the injection and compression molding methods;

coating the surface as one face of the first board-shaped dielectric material, the surface of each second board-shaped dielectric material, and the surface of the cylindrical member with a conductive coating by one of metallizing and metal plating processes; and providing at least one of a radiator and a set of parasitic elements as a strip-shaped conductive coat on one face of each third board-shaped member.

25. A method as claimed in claim 24, further comprising the steps of providing a strip line by metal-plating the other face of the first board-shaped dielectric material, and connecting the strip line with the radiator.

26. A method of manufacturing an antenna having a basic structure comprising:

a first board-shaped dielectric material;

a cylindrical member, one end face of which being in contact with one face of the first board-shaped dielectric material;

plural second board-shaped members provided as radiating on the outer surface of the cylindrical member, one end face of each second board-shaped member being in contact with the surface of the first board-shaped dielectric material; and plural sets of plural pole members perpendicular to the surface of the first board-shaped dielectric material, made by forcing out corresponding portions of the first broad-shaped dielectric materials, the sets radiating from the outer surface of the cylindrical member, the plural pole members in each set being arranged in a line, and each set existing between two positional directions of the adjacent two second board-shaped members, the method comprising the steps of:

forming the basic structure with a dielectric material using one of the injection and compression molding methods;

coating the surface as one face of the first board-shaped dielectric material and the surfaces of each above member with a conductive coating by metal coating;

providing a radiator on an extension of the line on which the plural pole members in each set are arranged, on the relevant face of the first board-shaped dielectric material, and between the innermost member of said plural pole members in a line and the outer surface of the cylindrical member;

providing a strip line by metal-plating the other face of the first board-shaped dielectric material; and connecting the strip line with the radiator.

* * * * *